US008191810B2

(12) United States Patent
Kitaguchi

(10) Patent No.: US 8,191,810 B2
(45) Date of Patent: Jun. 5, 2012

(54) CRUSHER

(75) Inventor: Atsushi Kitaguchi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 12/744,371

(22) PCT Filed: Mar. 24, 2009

(86) PCT No.: PCT/JP2009/055862
§ 371 (c)(1),
(2), (4) Date: May 24, 2010

(87) PCT Pub. No.: WO2009/136521
PCT Pub. Date: Nov. 12, 2009

(65) Prior Publication Data

US 2010/0252670 A1 Oct. 7, 2010

(30) Foreign Application Priority Data

May 8, 2008 (JP) ..... 2008-122648

(51) Int. Cl.
*B02C 13/26* (2006.01)

(52) U.S. Cl. ..... 241/189.1; 241/239; 241/242; 241/287

(58) Field of Classification Search ..... 241/268, 241/269, 242, 243, 237, 239, 241, 241.5, 241/189.1, 287, 288, 289, 290
See application file for complete search history.

(56) References Cited

U.S. PATENT DOCUMENTS 3,128,953 A * 4/1964 Wageneder ..... 241/241
7,900,858 B2 * 3/2011 Ragnarsson ..... 241/32

FOREIGN PATENT DOCUMENTS

| | | | |
|---|---|---|---|
| JP | 61-39101 | B2 | 9/1986 |
| JP | 2001-129423 | A | 5/2001 |
| JP | 2005-81244 | A | 3/2005 |
| JP | 2005-319349 | A | 11/2005 |
| JP | 2007-245070 | A | 9/2007 |

* cited by examiner

*Primary Examiner* — Mark Rosenbaum
(74) *Attorney, Agent, or Firm* — Mattingly & Malur, PC

(57) ABSTRACT

A crusher is provided that can quickly return to the operating state from a shutdown state which occurs due to the incorporation of a foreign object. Provided are a crushing rotor 32, a housing 41 and an anvil 33 supported by the housing to face a crushing chamber 31. A lever 90 is disposed on the side opposite the crushing rotor 32 with respect to the housing 41, pivotably installed with respect to side frames 19, and provided with a holding portion for holding the housing 41 to keep a posture where the anvil 33 faces the crushing chamber 31. An elastic member 93 is for biasing the lever 90 at a set biasing force. When the biasing force is exceeded, the lever 90 turns to permit the anvil 33 to turn and retreat from the crushing chamber 31.

10 Claims, 26 Drawing Sheets

CRUSHER

TECHNICAL FIELD

The present invention relates to a crusher for crushing object to be crushed.

BACKGROUND ART

Crushers are used to crush waste materials (to-be-crushed objects) such as waste wood, etc. for the main purpose of recycling of the waste materials and of reducing the volume thereof. One example of such crushers is known that is provided with a crushing apparatus including a crushing rotor arranged with crushing bits (rotating blades) on the outer circumferential portion thereof and an anvil (fixed blade) provided on the outer circumferential side of the crushing rotor.

A crusher of this type is as below for example. A housing provided with an anvil is held by a shear pin, and during the crushing work, when an excessive impactive force is applied to the fixed blade in such a case where foreign object (a metal block, etc.) may mix in to-be-crushed object and may be held between the bit of the crushing rotor and the fixed blade of the housing, the shear pin is broken to retreat the housing. Thus, the crusher (the fixed blade, etc.) is prevented from being damaged. (See patent document 1.)

JP, A 2005-319349

DISCLOSURE OF INVENTION

Problem to be Solved by the Invention

However, in the crusher configured to hold the housing by the shear pin, each time the shear pin is broken, the broken shear pin has to be replaced with a new one. This requires great care until the crusher is returned to work.

The present invention has been made in view of the foregoing and aims to provide a crusher that can quickly be returned to work from shutdown state due to the incorporation of a foreign object.

Means for Solving the Problem (1) To achieve the above object, the present invention provides a crusher including a crusher frame; a crushing rotor rotatably supported by the crusher frame; a housing pivotably mounted to the crusher frame; a fixed blade supported by the housing to face a crushing chamber around the crushing rotor; a lever disposed on a side opposite the crushing rotor with respect to the housing, installed pivotably with respect to the crushing frame, and provided with a holding portion for holding the housing to keep a posture where the fixed blade faces the crushing chamber; and biasing means for biasing the lever at a set biasing force and when a turning force applied to the lever via the holding portion exceeds the set biasing force, turning the lever to permit the fixed blade to turn and retreat from the crushing chamber.

As described above, the holding portion for holding the housing to keep a posture where the fixed blade faces the crushing chamber and the biasing means for biasing the lever at a set biasing force are provided, and when a turning force applied to the lever via the holding portion exceeds the biasing force, the lever is turned to permit the fixed blade to turn and retreat from the crushing chamber. Therefore, even in the event that a bit of the crushing rotor and the fixed blade of the housing hold therebetween a foreign object such as a metal block mixed in to-be-crushed object so that an excessive impactive force (the excessive load) is applied to the fixed blade, the fixed blade is turned and retreated. Thus, it is possible to prevent the bearings of the crushing rotor and the structure from being damaged by the excessive impactive force. In addition, the crusher can quickly be returned to work without the necessity of replacement with a new component part such as when a shear pin is broken.

(2) In the above (1), preferably, a roller is turnably provided at the holding portion of the lever to be abutted against the housing.

With this, when the housing is turned, the roller of the lever rolls on the housing to suppress friction occurring between the housing and the holding portion of the lever.

(3) In the above (1), preferably, the biasing means includes: a rod provided at one end of the lever turnably with respect to the lever and insertably fitted to a support member secured to the crusher frame; and spring means disposed between the lever and the support member so as to receive the rod passed therethrough.

(4) In the above (3), preferably, biasing force adjusting means for adjusting the biasing force of the spring means is provided.

With this, a load to turn and retreat the fixed blade due to the hardness of the to-be-crushed object or the like is adjusted to adjust a frequency where the fixed blade is turned and retreated during the crushing work. Therefore, while preventing the bearings of the crushing rotor and the structure from being broken, the crushing force to crush the object to be crushed is sufficiently ensured so that the crushing work can be carried out efficiently.

(5) In the above (1), preferably, the biasing means is disposed on the side of the housing with respect to the lever.

(6) In the above (1), preferably, the housing is provided with adjusting means for adjusting an amount of engagement with the holding portion of the lever.

With this, a load to turn and retreat the fixed blade due to the hardness of the to-be-crushed object is adjusted to adjust the frequency where the fixed blade is turned and retreated during the crushing work. Therefore, while preventing the bearings of the crushing rotor and the structure from being broken, the crushing force to crush the object to be crushed is sufficiently ensured so that the crushing work can be carried out efficiently.

(7) In the above (6), preferably, the adjusting means includes a latch abutted against the holding portion of the lever and a case secured to the housing to house the latch in such a manner that a portion of the latch is projected toward the holding portion, and the adjusting means adjusts the engaging amount by adjusting a projecting amount of the latch.

(8) In the above (7), preferably, the holding portion of the lever is such that an outer circumferential surface thereof abutted against the adjusting means is formed curved, the adjusting means includes a case secured to the housing and a latch provided in the case to be movable forward and rearward and to have a curved abutment portion against the holding portion, and a contact point between the latch and the holding portion shifts on the outer circumferential portion of the holding portion according to a forward-rearward movement amount of the latch with respect to the case to change the engaging amount between the latch and the holding portion.

(9) In the above (1), preferably, the housing is formed such that a distance from a turning center relative to the crusher frame to the fixed blade is made equal to a distance from the turning center to an abutment portion against the holding portion of the lever.

With this, the load applied to the fixed blade is made equal to the load applied to the holding portion via the housing. Therefore, the biasing force of the biasing means can easily be set accounting for the impactive force to turn and retreat the fixed blade from the crushing chamber.

(10) In the above (1), preferably, the housing is formed such that a distance from a turning center relative to the crusher frame to the abutment portion against the holding portion of the lever is made shorter than a distance from the turning center to the fixed blade.

With this, a range occupied by the housing in the crushing frame can be reduced. Therefore, the flexibility of the arrangement of the members including the housing can be increased.

(11) Further, in the above (1), preferably, the housing is formed such that a distance from a turning center relative to the crusher frame to an abutment portion against the holding portion of the lever is made longer than a distance from the turning center to the fixed blade.

With this, the force needed to hold the housing with respect to the impactive force applied to the blade force to keep a posture where the fixed blade faces the crushing chamber is reduced compared with the case where the distance from the turning center relative to the crushing frame to the fixed blade is equal to the distance from the turning center to the abutment portion against the holding portion of the lever. Therefore, the components such as the lever, the biasing means, etc., relating to the magnitude of the force pressing the housing can be reduced in size.

Advantage of the Invention

According to the present invention, the crusher can quickly be returned work from shutdown state due to the incorporation of a foreign object.

EXPLANATION OF REFERENCE NUMERALS

Figure 1:
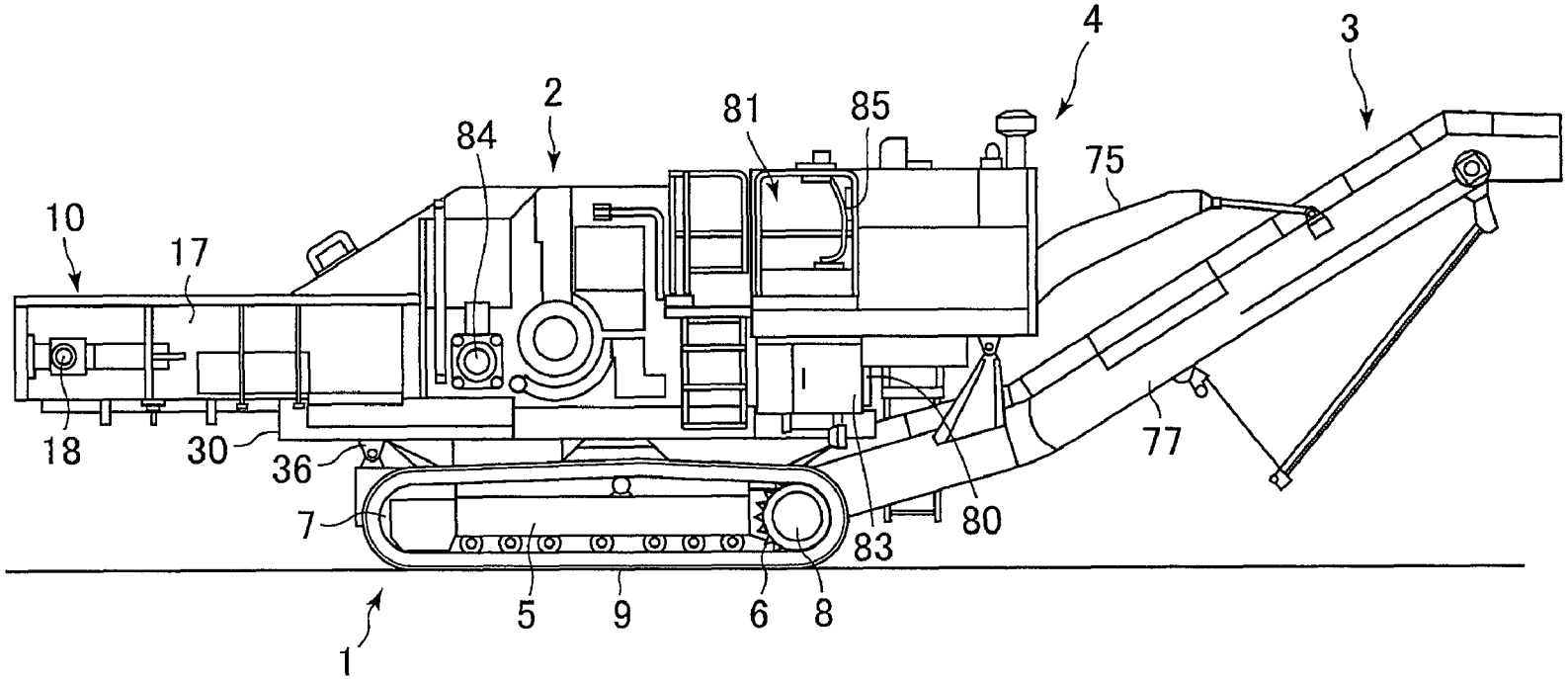
FIG. 1 is a lateral view illustrating an overall structure of a self-propelled crusher according to a first embodiment of the present invention.

1 Track body
2 Crushing function constituting portion
3 Discharge conveyor
4 Power arrangement
5 Track frame
10 Hopper
11 Feed conveyor
12 Crushing apparatus
13 Pressing roller device
14 Protection mechanism
15 Drive wheel
16 Conveyor belt
19 Side frame
20 Rotating shaft
22 Turning shaft
23 Support member
24 Pressing roller
27 Curved plate
28 Hydraulic cylinder
30 Body frame
31 Crushing chamber
32 Crushing rotor
33 Anvil
34 Support member
35 Crushing bit
36 Support member
38 Bolt
39 Curved plate
40 Screen
41 Housing
42 Turning shaft
48 Stopper support member
50 Stopper
51 Support member
63 Screen support member
64 Turning shaft
66 Hydraulic cylinder
69 Link mechanism
70 Slider
72 Arm
90 Lever
90*a*, 90*b*, 90*c* Pin
91 Rod
92 Shim
93 Elastic member
94 Lever support member
95 Roller
96 Lever bracket

BEST MODE FOR CARRYING OUT THE INVENTION

Embodiments of the present invention will hereinafter be described with reference to the drawings.

Figure 2:
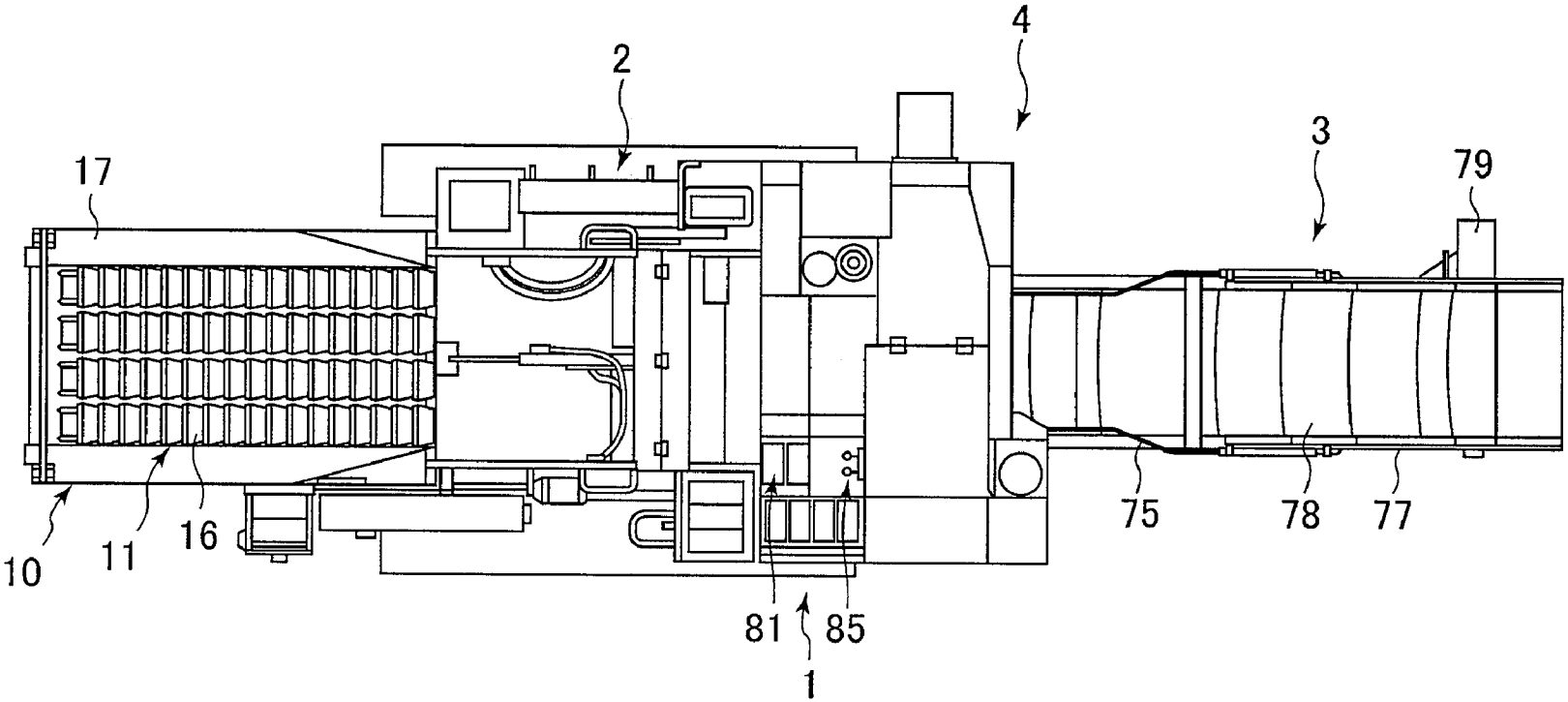
FIG. 2 is a plan view illustrating the overall structure of the self-propelled crusher according to the first embodiment of the present invention.
Figure 3:
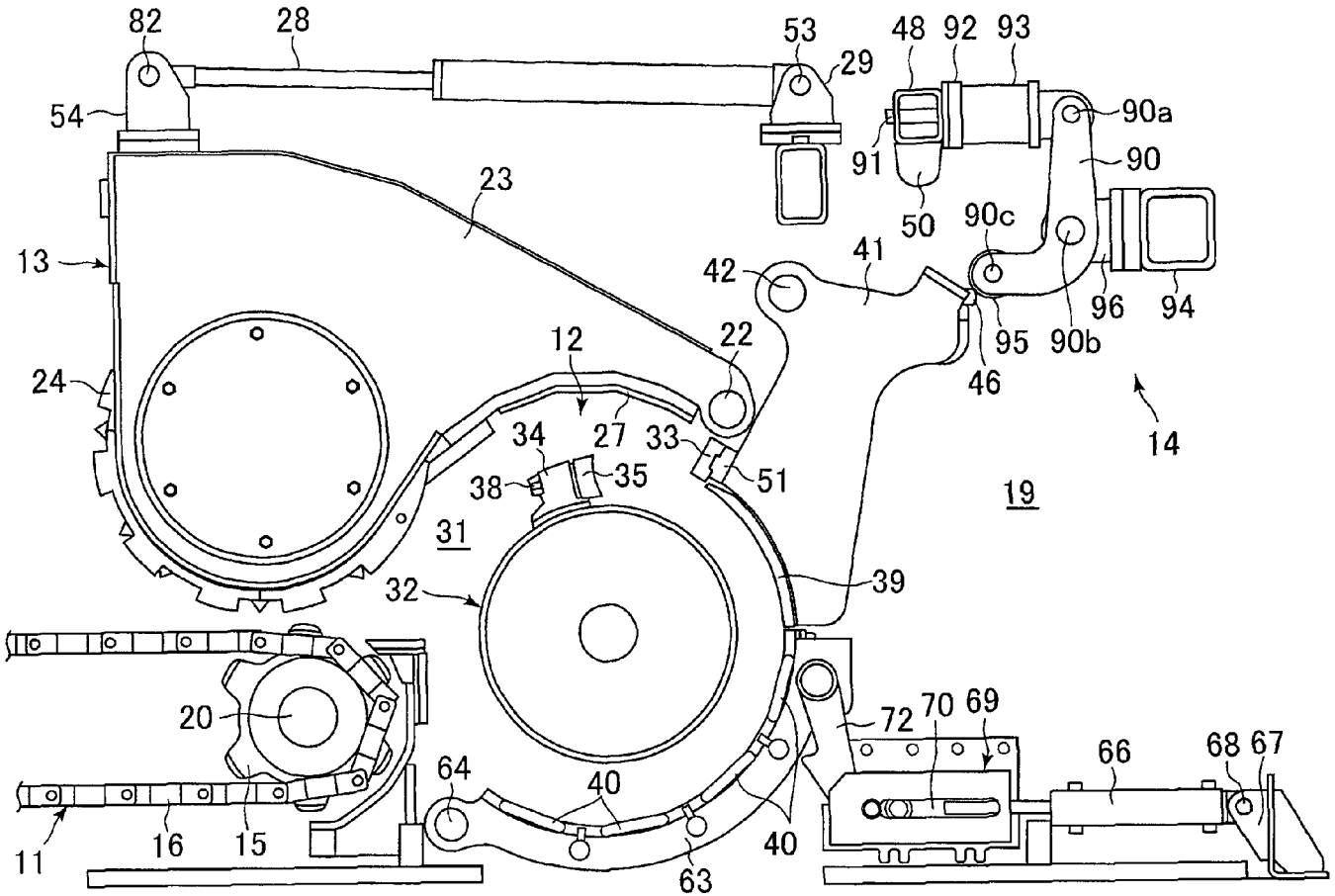
FIG. 3 is a perspective lateral view illustrating detailed structures of the vicinity of a crushing apparatus installed in the self-propelled crusher according to the first embodiment of the present invention, also illustrating a case where a housing lies at a closing position.
Figure 4:
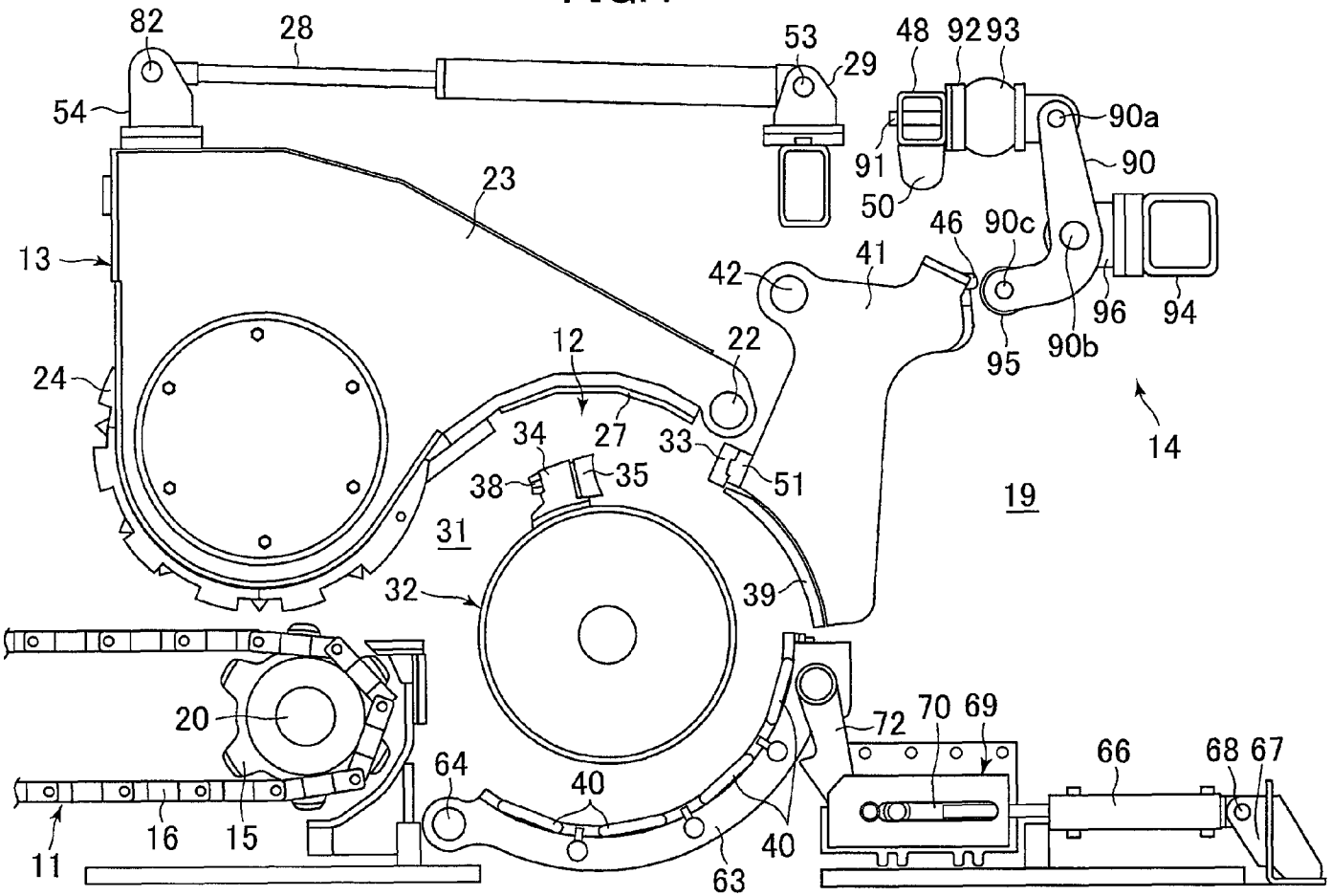
FIG. 4 is a perspective lateral view illustrating detailed structures of the vicinity of the crushing apparatus installed in the self-propelled crusher according to the first embodiment of the present invention, also illustrating a case where the housing is being turning.
Figure 5:
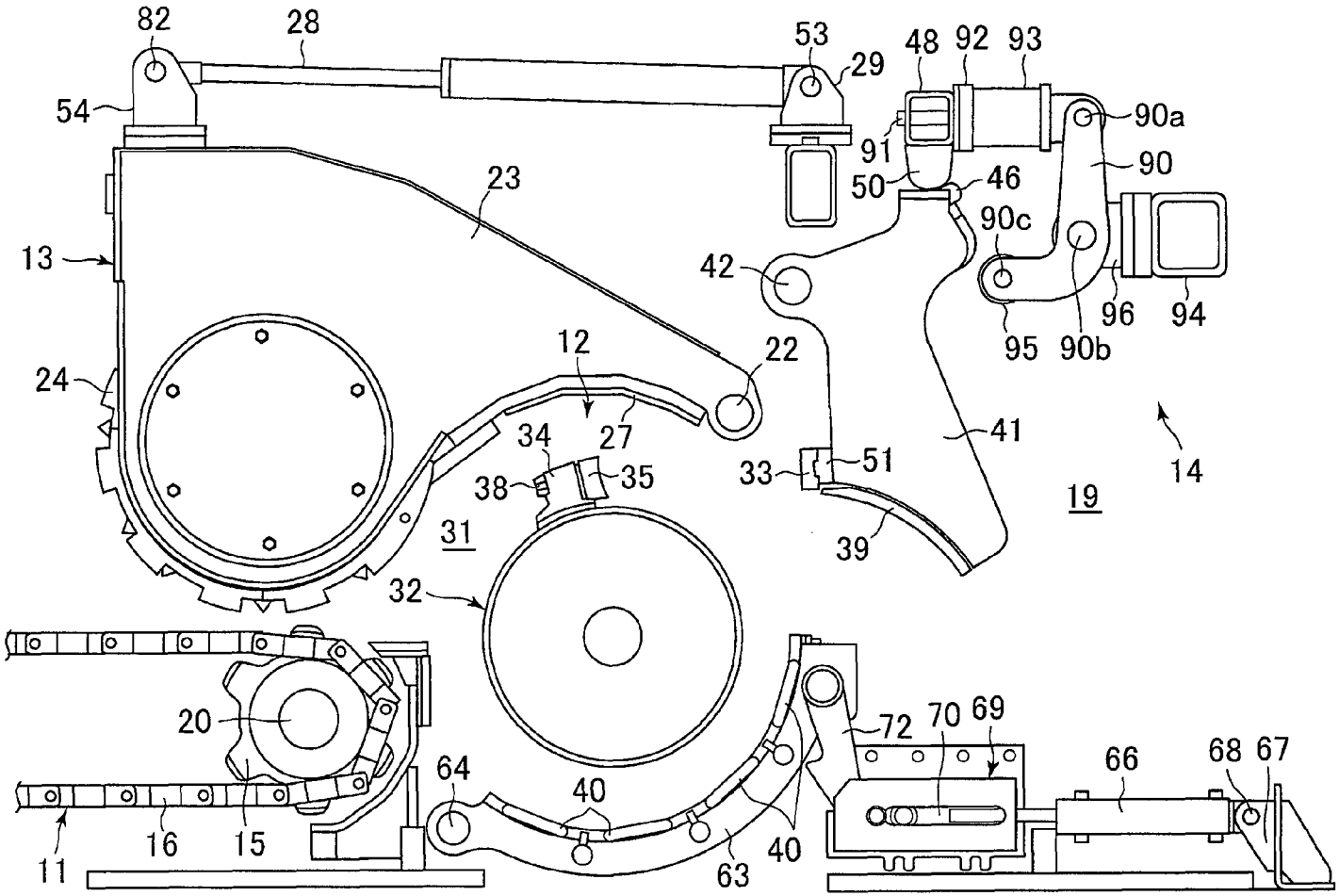
FIG. 5 is a perspective lateral view illustrating detailed structures of the vicinity of the crushing apparatus installed in the self-propelled crusher according to the first embodiment of the present invention, also illustrating a case where the housing lies at an opening position.

FIG. 1 is a lateral view illustrating an overall structure of a self-propelled crusher according to a first embodiment of the present invention. FIG. 2 is a plan view of FIG. 1. FIGS. 3 to 5 are perspective lateral views illustrating detailed structures of the vicinity of a crushing apparatus 12 installed in the self-propelled crusher illustrated in FIG. 1. FIG. 3 illustrates a case where a housing lies at a closing position. FIG. 4 illustrates a case where the housing is being turning. FIG. 5 illustrates a case where the housing lies at an opening position. Incidentally, directions corresponding to the left and right in FIGS. 1 and 2 shall be the rear and front, or one and the other, respectively, of the crusher.

Referring to FIGS. 1 and 2, the self-traveling crusher of the present embodiment generally includes: a track body 1 which allows self-propelling; a crushing function constituting portion 2 installed on the track body 1 to crush to-be-crushed object received; a discharge conveyor 3 which conveys the object crushed by the crushing function constituting portion 2 and discharges that to the outside; and a power arrangement 4 (a power unit) equipped with an engine, etc as a power source for devices mounted on the crusher.

The track body 1 includes: a track frame 5; a drive wheel 6 and a driven wheel 7 respectively provided at front each end and rear each end of the track frame 5; a drive device (traveling hydraulic motor) 8 having an output shaft connected to the shaft of the drive wheel 6; and a crawler belt (endless crawler belt) 9 wound around the drive wheel 6 and driven wheel 7. A body frame 30 is mounted on the track frame 5 and supports the crushing function constituting portion 2, the discharge conveyer 3, the power arrangement 4, etc.

The crushing function constituting portion 2 includes: a hopper 10 adapted to receive to-be-crushed object to be fed; a feed conveyer 11 (see FIG. 2) as conveying means for the to-be-crushed object received and arranged in the hopper 10; the crushing apparatus 12 (see FIGS. 3 to 5) for crushing the to-be-crushed object introduced by the feed conveyer 11; and a pressing roller device 13 (see FIGS. 3 to 5) for pressing the to-be-crushed object to be introduced into the crushing apparatus 12 against the feed conveyer 11 before the crushing apparatus 12.

The feed conveyor 11 includes: a sprocket-like drive wheel 15 provided on the side (on the front side of the crusher) of a crushing rotor 32 described later; a driven wheel not illustrated provided on the side opposite the drive wheel 15 (on the rear side of the crusher); and a conveying body (a conveying belt, a chain belt) 16 composed of a plurality of widthwise lines (e.g., 4 lines, see FIG. 2) wound between the drive wheel 15 provided on each end portion of the conveying-direction and the driven wheel.

The driven wheel is supported by bearing 18 (see FIG. 1) provided at the rear portion of lateral wall body 17 (see FIG. 1) of the hopper 10. The drive wheel 15 is supported by bearing 84 provided on side frame 19 (see FIG. 3) of the crushing apparatus 12 provided on the front side of the lateral wall body 17. In this way, the feed conveyor 11 is provided to extend generally horizontally from the internal lower portion of the hopper 10, i.e., from the inside of the lateral wall body 17 of the hopper 10 to the vicinity of a crushing rotor 32

(described later) and housed and arranged in the hopper 10 and in the side frames 19 of the crushing apparatus 12.

A rotating shaft 20 of the drive wheel 15 of the feed conveyer 11 is connected, via a coupling or the like, to an output shaft of a drive device (not illustrated) provided widthwise-externally of the bearings. The feed conveyor 11 is designed to drivingly circulate the conveying body 16 between the drive wheel 15 and the driven wheel by allowing a drive device not illustrated to drivingly rotate the drive wheel 15.

The pressing roller device 13 is provided close to the rear side of the crushing rotor 32 (described later) and above the conveyor 11 so as to face the conveying surface of the feed conveyor 11. While pressing the to-be-crushed object conveyed on the feed conveyor 11 from above, the pressing roller device 13 introduces that toward the crushing rotor 32. The pressing roller device 13 has a pivot shaft 22 journaled above the crushing apparatus 12 by bearings provided on the side frames 19. The pressing roller device 13 includes: a support member (arm) 23 turnably supported (vertically swingably in FIG. 3) in a vertical plane; and a pressing roller 24 provided rotatably with respect to the support member 23.

The support member 23 is provided with the pivot shaft 22 at one end and with the pressing roller 24 at the other end (one end on the leading end side). A lower side end face (the end face facing the upper portion of the crushing rotor 32) of the support member 23 is formed to be bent into an arc. A curved plate 27 constituting part of a crushing chamber 31 described later is attached to this bending surface. On the other hand, the support member 23 has a portion which is attached with the pressing roller 24, and the portion is formed to be bent into an arc having a diameter smaller than that of the pressing roller 24 and the outer circumferential surface of the pressing roller 24 is configured to protrude from the support member 23. The pressing roller 24 is set to have a widthwise (direction perpendicular to the sheet surface of FIG. 3) size equal to or greater than the width of the conveying surface of the feed conveyor 11.

The pressing roller 24 has a drive device (not illustrated) built in its barrel portion. The pressing roller 24 is drivingly rotated by this drive device at a circumferential velocity generally equal to the conveying speed of the to-be-crushed object conveyed on the conveying surface of the feed conveyor 11. The pressing roller 24 works with the feed conveyor 11 to introduce the to-be-crushed object pressed on the feed conveyor 11 into the crushing chamber 31.

A hydraulic cylinder 28 has a bottom side leading end turnably connected via a pin 53 to a bracket 29 secured to the side frames 19; and a rod side leading end turnably connected via a pin 82 to a bracket 54 provided at a rear side (on the left side in FIG. 3) leading end of the support member 23. The extending and contracting movement of the hydraulic cylinder 28 can turn the pressing roller device 13 around the pivot shaft 22 to move it up and down with respect to the feed conveyor 11 (in other words, to bring it away from or close to the crushing apparatus 12).

The crushing apparatus 12 is located at a generally central portion in the longitudinal direction of the body frame 30 (see FIG. 1). As illustrated in FIG. 3, the crushing apparatus 12 includes: a crushing rotor 32 rotating at high speeds in the crushing chamber 31; an anvil (fixed blade) 33 provided on the radially outside of the crushing rotor 32; and a protection mechanism 14 for protecting the anvil 33, the crushing rotor 32, etc. A curved plate 27, the anvil 33, a curved plate 39, screens (sieves) 40, etc. are provided around the crushing rotor 32 from a portion (the portion rearward of the crushing apparatus 12) adapted to receive to-be-crushed object supplied thereto by the feed conveyer 11 and the pressing roller 24 in the normal-rotational direction of the crushing rotor 32 (the clockwise direction, in the flowing direction of to-be-crushed object in FIG. 3) so as to surround the crushing rotor 32. The crushing chamber 31, a cylindrical space, in which crushed pieces go around the crushing rotor 32, is defined by these curved plate 27, the anvil 33, the curved plate 39, the screens 40, etc.

The crushing rotor 32 is rotatably supported by bearings (not illustrated) provided on support members not illustrated and provided on the side frames 19 or on body frame 30 of the crushing apparatus 12. The crushing apparatus 32 is provided on the outer circumferential portion with a plurality of set constituted by support members 34 and crushing bits (collision plates, crushing blades or the like) 35 attached to the front sides, in the normal-rotational direction, of the support members 34 by means of bolts 38. The crushing bit 35 is disposed such that its blade surface precedes the support member 34 when the crushing rotor 32 rotates in the normal-rotational direction. This blade surface strikes the to-be-crushed object. Incidentally, FIGS. 3 to 5 typically depict a set constituted by the crushing bit 35, the support 34 and the bolt 38.

The anvil 33 has a collision surface 33*a* with which the to-be-crushed object introduced into the crushing chamber 31 collides. The anvil 33 is attached via a support member 51 to a portion on the upstream side, in the normal-rotational direction, of the crushing rotor 32 relative to the attachment portion of the curved plate 39 of the housing 41 so that the collision surface 33*a* may face the crushed pieces (the to-be-crushed object) circulating in the crushing chamber 31 along with the rotation of the crushing rotor 32. The support member 51 is attached to the housing 41 by means of bolts or the like not illustrated.

The housing 41 holds the anvil 33 on the side of crushing chamber 31. The housing 41 is pivotably supported in the back and forth direction with a pivot shaft 42, serving as a fulcrum, supported by bearings not illustrated provided on the side frames 19 above the pivot shaft 22 of the pressing roller device 13. In addition, the housing 41 is provided with an engaging portion 46 protruded therefrom at its front end portion extending forward as viewed from the pivot shaft 42. The housing 41 is formed so that a distance from the pivot shaft 42 to the anvil 33 may be generally equal to a length (distance) from the pivot shaft 42 to the engaging portion 46. Incidentally, the pivot shaft 42, anvil 33 and engaging portion 46 of the housing 41 correspond to a fulcrum, a point of effort and a point of load, respectively, in the principle of leverage. Thus, almost the same load as a load applied to the anvil 33 (the point of effort) is applied to the engaging portion 46 (the point of load). During the normal time period (during the crushing work), the engaging portion 46 of the housing 41 is supported by the holding portion of a protection device 14 (described later) provided on the inner wall surface of the side frames 19. In addition, the anvil 33 is held at a closing position (the position indicated in FIG. 3) opposed to the to-be-crushed object in the crushing chamber 31. During the crushing work, if an excessive load is applied to the anvil 33, a load generally equal to such an excessive load is applied to the protection device 14 to shift the holding portion of the protection device 14. This releases the restraint of the housing 41 (see FIG. 4). Consequently, the housing 41 is turned around the pivot shaft 42 to an opening position (the position indicated in FIG. 5) where the anvil 33 retreats from the crushing chamber 33.

The screens 40 are provided on the downstream side of the curved plate 39 in the flowing direction of the to-be-crushed object and on the radially outside of the crushing rotor 32, and are arranged almost along with the arc having the same center as the crushing rotor 32. In addition, the screens 40 are provided with a plurality of discharge holes (not illustrated) which pass through the screens 40 from an inner diameter surface opposed to the crushing rotor 32 to the opposite surface to discharge the crushed pieces. Crushed pieces each of which has a diameter smaller than the diameter of the discharge hole not illustrated are discharged to the outside of the crusher.

A frame-like screen support member (a screen holder) 63 holding the screens 40 on the outer circumferential position of the crushing rotor 32 is provided below the crushing rotor 32. The screen support member 63 is configured such that its rear end portion is secured via a pivot shaft 64 to a support member not illustrated or the like provided on the side frames 19 or on the body frame 30 so as to vertically turn around the pivot shaft 64. On the front end portion of the screen support member 63, a link mechanism 69 adapted to move the screen support member 63 forward and rearward with respect to the crushing rotor 32.

The link mechanism 69 includes a hydraulic cylinder 66, a slider 70 and an arm 72. The hydraulic cylinder 66 is pivotably connected at a bottom side end portion thereof, via a pin 68, to a bracket 67 secured to the side frames 19. The slider 70 is provided at a rod side end portion of the hydraulic cylinder 66 so as to be moved forward and rearward along with the extension and contraction of the hydraulic cylinder 66. One end of the arm 72 is pivotably connected to the front end portion of the screen support member 63 and the other end thereof is pivotably connected to the slider 70. The contraction of the cylinder 66 lowers the screen support member 63 from the state shown in FIG. 3.

FIG. 3 illustrates the state of the crushing apparatus during the crushing work, in which the link mechanism 69 holds the posture of the screen support member 63 by the extension of the hydraulic cylinder 66. When hydraulic fluid inside the hydraulic cylinder 66 is pressurized, the other side end of the arm 72, i.e., the end on the side of the slider 70 is parallel shifted in the pressurized direction (rightward in FIG. 3) of the cylinder 66 together with the slider 70 to turn downward the screen support member 63 around the pivot shaft 64. In this way, when the screen support member 63 is lowered, the screen 40 placed on the screen support member 63 can laterally be drawn from a cut-away portion (not illustrated) formed on the lower portion of the side frame 19. Thus, the screen 40 can be replaced with ease.

Returning now to FIGS. 1 and 2, the discharge conveyor 3 has a discharge side (front side) portion suspended and supported by a support member 75 provided to project from the power arrangement 4. In addition, a (rear side) portion opposite the discharge side portion is suspended and supported by the body frame 30 via a support member 36. In this way, the discharge conveyor 3 is arranged to be passed between below the crushing apparatus 12 and below the power arrangement 4 and inclined upward from below the power arrangement 4 to the front external of the self-propelled crusher. The discharge conveyor 3 includes a frame 77 and a conveyor cover 78. The conveyor cover 78 is provided above a conveyor belt (not illustrated) wound between a drive wheel (not illustrated) and a driven wheel (not illustrated) which are provided at both longitudinal ends of the frame 77. The drive wheel (not illustrated) of the discharge conveyor 3 is connected via a coupling or the like to the output shaft of a drive unit (a hydraulic motor for discharge conveyor) 79 provided widthwise-externally of a bearing. The drive unit 79 is rotationally driven to drivingly circulate the conveyor belt between the drive wheel and the driven wheel.

The power arrangement 4 is mounted on the other side end, in the longitudinal direction, of the body frame 30 via a support member 80. A cab seat 81 is provided in a compartment behind the power unit 4 and on one side (the lower side in FIG. 2) in the width direction. A control lever 85 for traveling operation is provided forward of the cab seat 81. A control panel 83 is provided on the lower lateral side of the cab seat 81 of the self-traveled crusher to perform operation other than the traveling operation, setting, monitoring, etc.

The protection device 14 described earlier is next detailed with reference to FIGS. 3 to 7.

Figure 6:
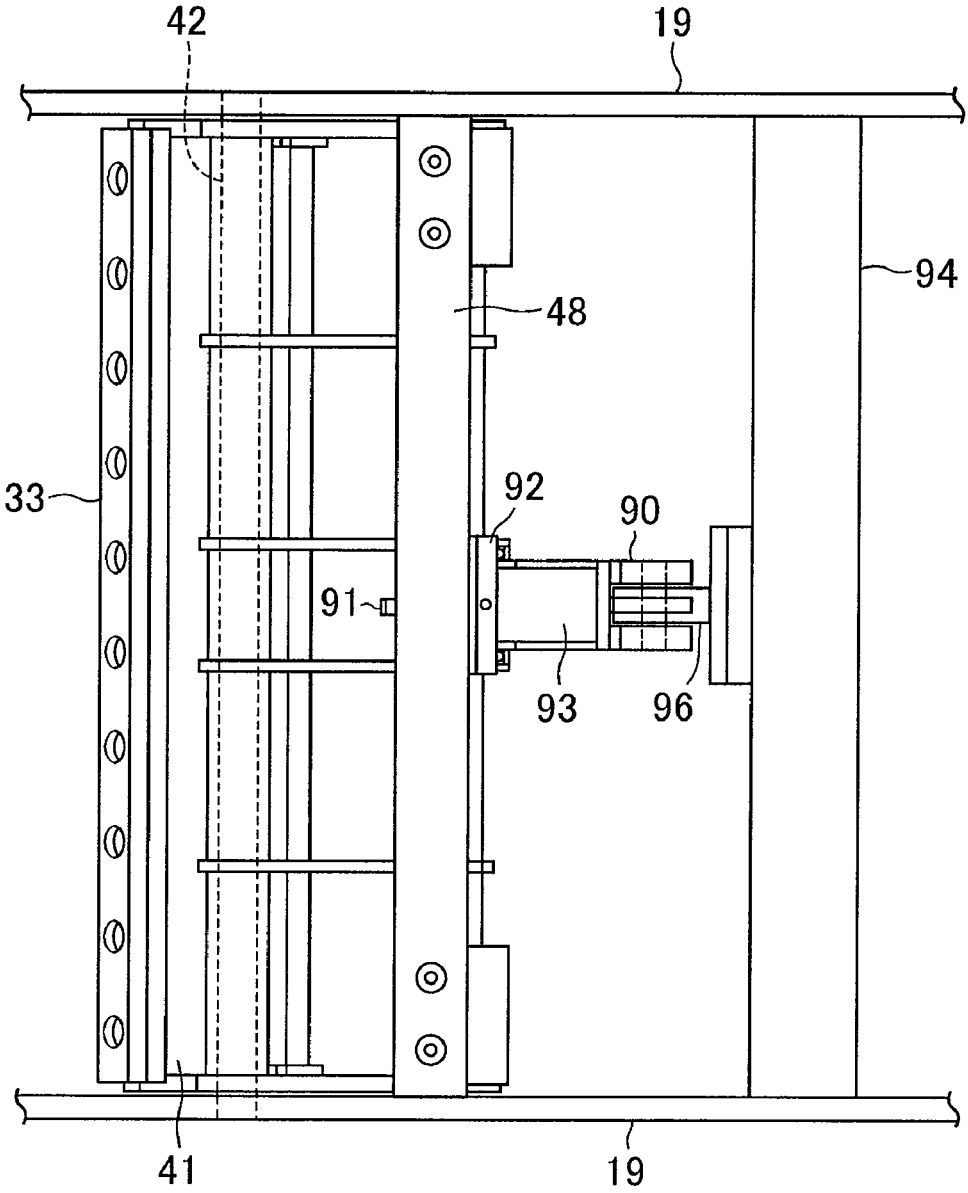
FIG. 6 is a plan view extracting and illustrating a protection device and the housing according to the first embodiment of the present invention along with peripheral configurations.
Figure 7:
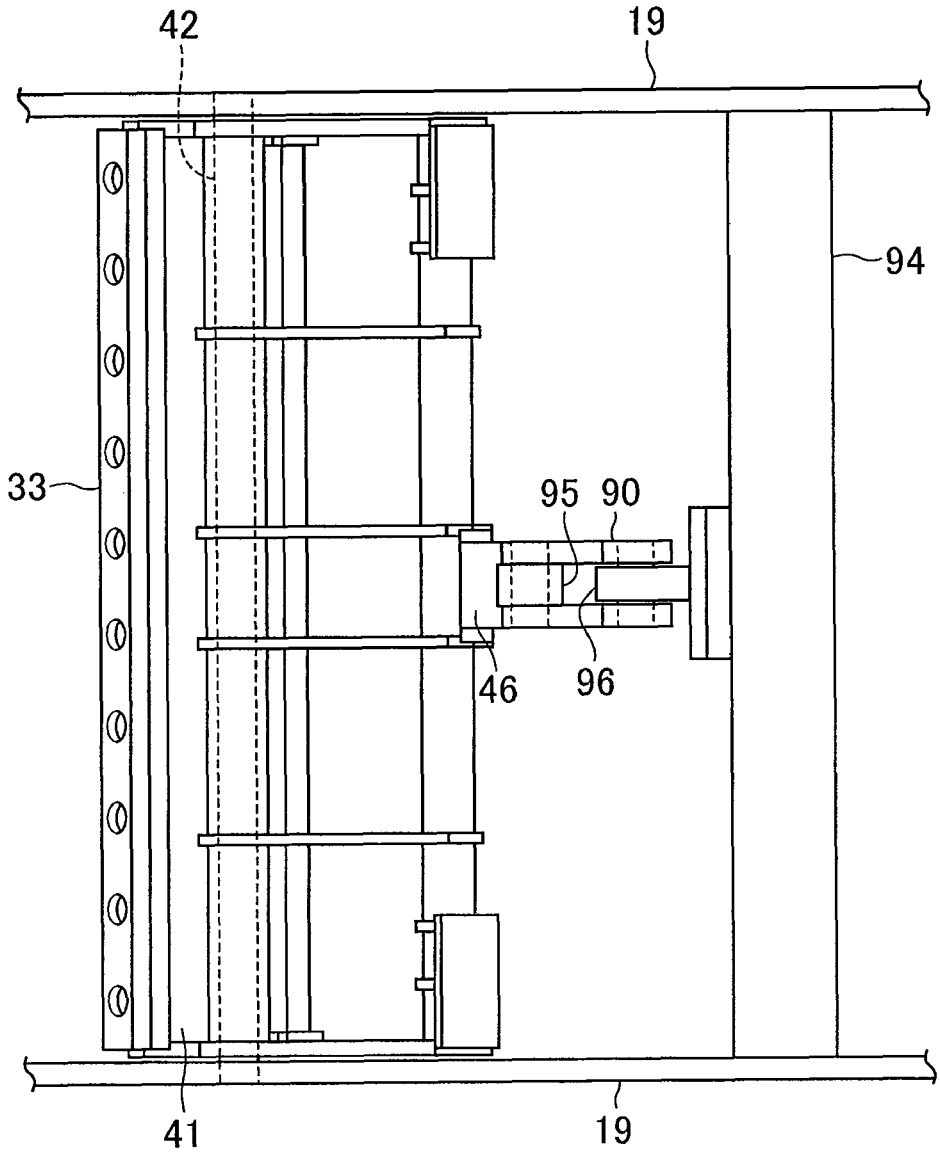
FIG. 7 is a perspective plan view illustrating details of the housing and a lever according to the first embodiment of the present invention.

FIG. 6 is a plan view illustrating the protection device 14 and housing 41 extracted from the illustration of FIG. 3 along with the peripheral configurations. FIG. 7 is a detailed perspective plan view illustrating the housing 41 and lever 90 shown in FIG. 6. The left and right directions in FIGS. 6 and 7 correspond to the rear and front directions, respectively, of the self-traveled crusher illustrated in FIGS. 1 to 5.

The protection device 14 includes a lever bracket 96, the lever 90, a roller 95, a rod 91, an elastic member 93 and a shim 92. The lever bracket 96 is provided on a lever support member 94 disposed along the body-width direction (the vertical direction in FIG. 6) and secured at both ends thereof to the side frames 19, 19. The lever 90 is pivotably provided on the lever bracket 96 via a pin 90*b*. The roller 95 is turnably provided at one end of the lever 90 close to the housing 41 via the pin 90*a*. The rod 91 is turnably provided at one end of the lever 90 opposite the housing 41 via a pin 90*a*. The elastic member 93 is interposed between the lever 90 and the stopper support member 48 through the rod 91. The shim 92 is inserted between the lever support member 94 and the elastic member 93.

The lever support member 94 is disposed forward of the housing 41.

The lever bracket 96 is provided at the general center of the lever support member 94 secured at both ends thereof to the side frames 19, 19, i.e., at a position corresponding to the engaging portion 46 of the housing 41. In addition, the lever bracket 96 is provided to project from the lever support member 94 toward the housing 41.

The lever 90 has a converse L-shape bending toward the housing 41 (leftward in FIG. 3). The lever 90 is pivotably connected via the pin 90*b* to the lever bracket 96 at a position where the distance between one end close to the pin 90*a* (close to the rod 91) and the pin 90*b* is greater than the distance between one end close to the pin 90*c* (close to the housing 41) and the pin 90*b*. A force (turning force) applied in the turning direction to the one end close to the pin 90*a* and corresponding to the point of effort in the principle of leverage becomes a greater force (the turning force) at the one end close to the pin 90*c* corresponding to the point of load because of passing the pin 90*b* corresponding to the fulcrum.

A portion of the lever 90 extending from the pin 90*b* to the side of the pin 90*c* plays a role of a holding portion. This holding portion is provided at one end of the lever 90 close to the housing 41 to hold the engaging portion 46 of the housing 41 to keep a posture where the anvil 33 faces the crushing chamber 31. The roller 95 is turnably provided via the pin 90*c* at a contact position of the holding portion with the engaging portion 46. When the engaging portion 46 moves with respect to the holding portion of the lever 90, the roller 95 rolls on the engaging portion 46 to reduce the friction force occurring between the holding portion and the engaging portion 46.

The rod 91 is pivotably provided via the pin 90*a* at one end of the lever 90 on the side opposite the housing 41 and is insertably fitted into the stopper support member 48 secured to the side frames 19, 19. The stopper support member 48 is disposed above the housing 41 (the upper direction in FIG. 3). The rod 91 extends from the pin 90*a* of the lever 90 toward the stopper support member 48.

The elastic member 93 is an elastic member made of e.g. a rubber spring, an urethane spring or the like and is interposed between the lever 90 and the stopper support member 48 so as to receive the rod 91 passed therethrough.

The shim 92 is inserted between the stopper support member 48 and the elastic member 93 and secured with a bolt or the like so as not to drop off. This shim 92 is biasing force adjusting means for adjusting the biasing force of the elastic member 93 against the lever 90. If the number of the shims 92 is increased or the shim 92 is replaced with a thicker shim, the biasing force of the elastic member 93 against the lever 90 is increased to thereby increase the holding force of the holding portion of the lever 90 for the housing 41. Reversely, if the number of the shims 92 is reduced or the shim 92 is replaced with a thinner shim, the biasing force of the elastic member 93 against the lever 90 is reduced to thereby reduce the holding force for the housing 41 resulting from the holding force of the lever 90.

As described above, the rod 91 and the elastic member 93 constitute biasing means for biasing the lever at a set biasing force, turnably operating the lever 90 when the turning force applied to the lever 90 via the holding portion exceeds the biasing force, to permit the turning retreat of the anvil 33 from the crushing chamber 31. The shim 92 constitutes biasing force adjusting means for adjusting the biasing force of the elastic member 93.

Returning to FIGS. 3 to 5, during the crushing work (in the state illustrated in FIG. 3), the housing 41 is such that the engaging portion 46 thereof is fixed and held at a closing position by the holding portion of the lever 90 of the protection device 14 mounted to the side frames 19, i.e., in the posture where the anvil 33 is disposed in the vicinity of the rotational trajectory of the crushing bit 35. In this case, the roller 95 provided on the holding portion of the lever 90 presses rearward the engaging portion 46 of the housing 41 by the biasing force of the elastic member 93 transmitted via the lever 90. In the case where the force of the engaging portion 46 pressing the roller 95 forward exceeds the biasing force of the elastic member 93 transmitted to the roller 95 via the lever 90, the lever 90 is turned to shift forward the roller 95 provided on the holding portion. As a result, the engaging portion 46 of the housing 41 rides across the roller 95, thereby permitting the turning of the housing 41. With such a configuration, if an excessive impactive force is applied to the anvil 33, the lever 90 of the protection device 14 is turned in an opening direction (counterclockwise in FIG. 3) to release the restraint of the engaging portion 46 by the holding portion. The housing 41 is turned around the pivot shaft 42 to allow the anvil 33 to retreat from the crushing chamber 31. Thus, components of the crusher including the anvil 33 can be prevented from being damaged. In this case, even after the anvil 33 has been retreated from the crushing chamber 31 by the excessive load in this embodiment as illustrated in FIG. 5, by depressing from above the engaging portion 46 of the housing 41 by means of e.g., a cylinder, a manual jack, a hand or the like, the posture of the housing 41, i.e., the position of the anvil 33 with respect to the crushing chamber 31 can be returned to the state shown in FIG. 3. A stopper 50 is provided on a stopper support member 48 secured to the side frames 19. This stopper 50 limits the turning range of the housing 41 in the opening direction (counterclockwise in FIG. 3) thereof. Thus, the housing 41 and the other constituent elements can be prevented from interfering with each other.

A description is given of the operation of the present embodiment configured as above.

After to-be-crushed object is fed into the hopper 10 by a heavy machine (a hydraulic shovel or the like) equipped with an appropriate working tool such as a grapple, the object is put on the conveyor belt 16 of the feed conveyor 11 and conveyed toward the crushing apparatus 12 by the circulating-driving conveyor belt 16. When the to-be-crushed object is conveyed to near the pressing roller device 13, the pressing roller 24 runs on the to-be-crushed object. In this state, the to-be-crushed object is pressed against the conveying surface of the feed conveyor 11 by the pressing roller's own weight. In this way, in the state where the to-be-crushed object is gripped between the pressing roller 24 and the feed conveyor 11, the pressing roller 24 introduces the to-be-crushed object into the crushing chamber 31 in cooperation with the feed conveyor 11. In this case, the to-be-crushed object projects toward the inside of the crushing chamber 31 in such a cantilever manner that a portion of the to-be-crushed object gripped between the pressing roller 24 and the feed conveyor 11 is made to serve as a fulcrum.

The crushing bits 35 of the crushing rotor 32 rotating at high speed collide from below with the to-be-crushed object projecting into the crushing chamber 31, thereby roughly crushing it (first crushing). The crushed pieces thus roughly crushed and struck up in the crushing chamber 31 collide with the anvil 33 to be more finely crushed by the impactive force. Also thereafter, the crushed pieces go-around in the crushing chamber 31 along with the rotation of the crushing rotor 32 and collide with the crushing bits 35, the anvil 33, the inner wall surface of the crushing chamber 31, etc. (secondary crushing). Of the circulating crushed pieces, crushed pieces that are made finer into such a size as to pass through the discharge holes of the screens 40 sequentially pass through the screens 40 and are discharged from the crushing chamber 31. The crushed pieces discharged from the crushing chamber 31 drop onto the discharge conveyor 3 to be conveyed and discharged to the outside of the crusher.

When the secondary crushing mentioned above is carried out during the crushing work as describe above, the crushing bit 35 and the anvil 33 may hold therebetween a foreign object such as a stone, metal or the like. In such an event, an excessive load is applied from the crushing bit 35 to the anvil 33 and transmitted to the holding portion of the lever 90 of the protection device 14 via the engaging portion 46 of the housing 41.

In the event that the excessive impactive force is applied to the anvil 33 or the like, the lever 90 of the protection device 14 is turned in the opening direction (counterclockwise in FIG. 3) to release the restraint of the engaging portion 46 by the holding portion. Because of the configuration of the protection device 14 as mentioned above, the housing 41 and the anvil 33 are turned around the pivot shaft 42 with respect to the side frames 19 to retreat from the crushing chamber 31. Thus, components of the crusher including the anvil 33 are prevented from being damaged.

The hopping impactive force of the housing 41 encountered when the housing 41 is turned and retreated is absorbed by the stopper 50. In addition, the housing 41 is returned to the original position (the closing position) by its own weight. However, if a position sensor not illustrated or the like detects the retreat of the housing 41, the self-traveled crusher stops the operation for crushing the to-be-crushed object, specifically, the carrying-in of to-be-crushed object by the conveyor 11 or the like, the rotation of the crushing rotor 32, etc.

In the embodiment configured as described above, the engaging portion 46 is provided opposite the anvil 33 of the housing 41 and held by the holding portion of the lever 90. In addition, the operation of the engaging portion 46 is permitted by the biasing means via the lever 90. Therefore, even in the event that the crushing bit 35 and the anvil 33 hold therebetween a foreign object such as a stone, metal or the like, the biasing means and the lever 90 are turned to turn the housing 41 supporting the anvil 33, thereby retreating the anvil 33 from the crushing chamber 31. Thus, it is possible to prevent an excessive load from being applied via the crushing bits 35 to the bearings of the crushing rotor 32 and the structure including the anvil 33. As a result, the bearing of the crushing rotor and the structure can be prevented from being damaged and also the crusher can quickly be returned to work without the necessity of replacement with a new component part such as when a shear pin is broken.

The biasing force adjusting means for adjusting the biasing force of the biasing means against the lever 90 is provided. Therefore, the frequency of turning-retreat of the housing 41 during the crushing work can be adjusted by force (hereinafter called the holding force) depending on the hardness of a to-be-crushed object, such a holding force being adapted to hold the holding portion of the lever in the posture of the anvil 33 facing the crushing chamber 31 by the holding portion of the lever 90 holding the engaging portion 46 of the housing 41. For example, in the case of to-be-crushed object having a less possibility of foreign object incorporation and an easily crushing property, the crushing apparatus is less liable to come into an excessive load state. Therefore, the biasing force is adjusted to set the holding force to a large level, which makes it possible to crush the to-be-crushed object more reliably. On the other hand, in the case of to-be-crushed object having a high possibility of foreign object incorporation, such as e.g. mixed waste, the crushing apparatus is likely to come into an excessive load state. Therefore, the biasing force is adjusted to set the holding force at a small level, which makes it easy for the anvil 33 to retreat, thereby preventing any damage to the crushing apparatus. As described above, the holding force resulting from allowing for both prevention of damage to the bearings of the crushing rotor 32 and to the structure and ensuring of the crushing force for the to-be-crushed object can be set so that the crushing work can be carried out efficiency.

Further, the housing 41 is formed such that the distance from the pivot shaft 42 to the anvil 33 is made generally equal to the length from the pivot shaft 42 to the engaging portion 46. Therefore, the load applied to the engaging portion 46 is generally equal to that applied to the anvil 33. Thus, it is easy to set the biasing force of the biasing means allowing for the load applied to the anvil 33. When an installation space for the housing 41 and the protection device 14 is limited, the length (distance) from the pivot shaft 42 of the housing 41 to the engaging portion 46 may be made shorter than the length from the pivot shaft 42 to the anvil 33. In this case, the load greater than the load applied to the anvil 33 or the point of load is applied to the engaging portion 46 or the point of effort. However, it is possible to deal with such a greater load by increasing the holding force for holding the engaging portion 46 of the housing 41 by changing the installation position of the pin 90*b* of the lever 90 or a fulcrum, or by adjusting the biasing force of the elastic member 93. In contrast, when the installation space for the housing 41 and the protection device 14 has room, the length from the pivot shaft 42 of the housing 41 to the engaging portion 46 may be made greater than the length from the pivot shaft 42 to the anvil 33. In this case, the load smaller than the load applied to the anvil 33 or the point of effort is applied to the engaging portion 46 or the point of load. Therefore, the protection device 14 can allow the holding force for holding the engaging portion 46 of the housing 41 to have room. Thus, the advantage such as downsizing of the protection device 14 can be expected.

Figure 8:
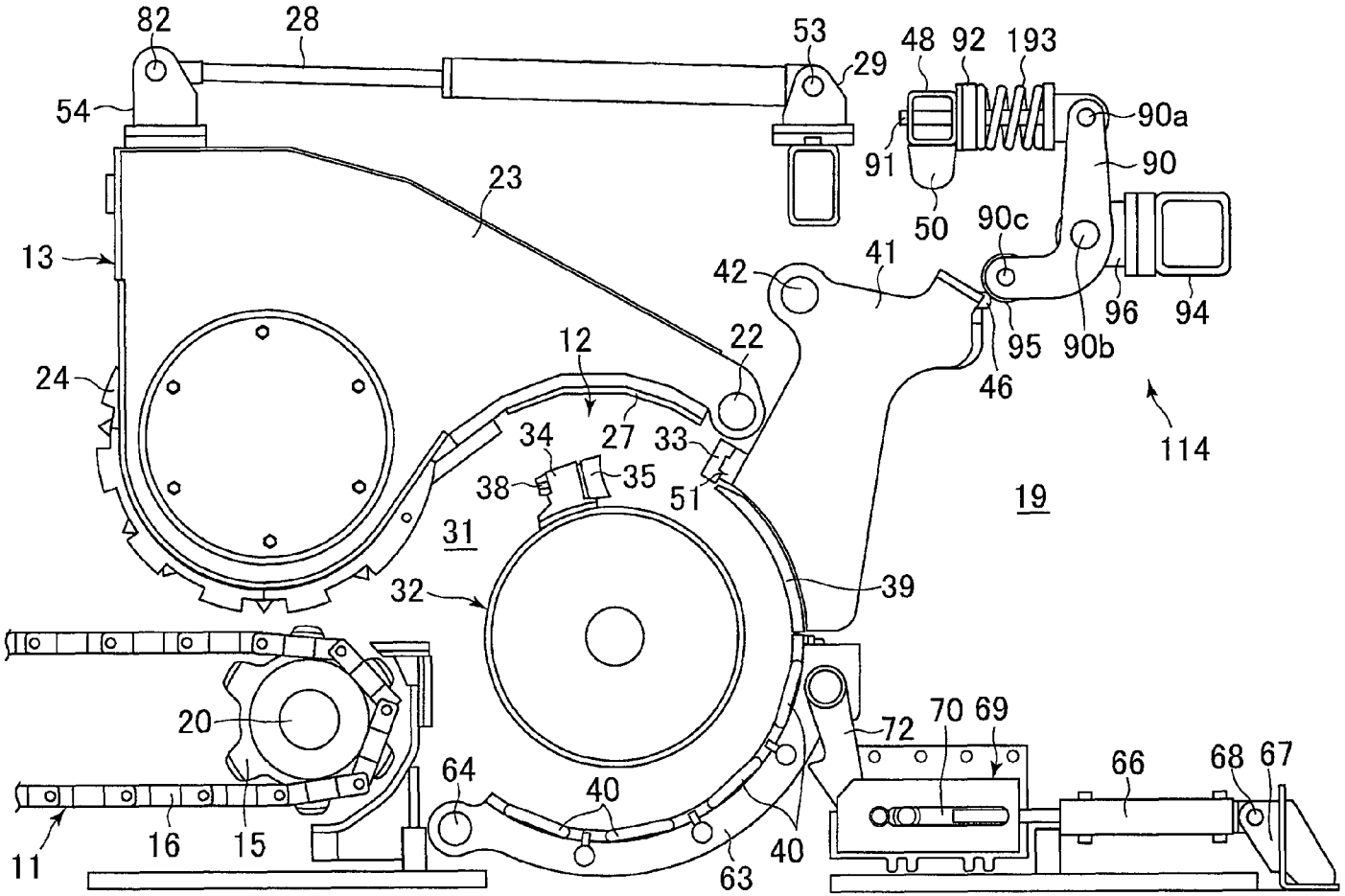
FIG. 8 is a perspective lateral view illustrating detailed structures of the vicinity of a crushing apparatus installed in a self-propelled crusher according to a modification of the first embodiment of the present invention.
Figure 9:
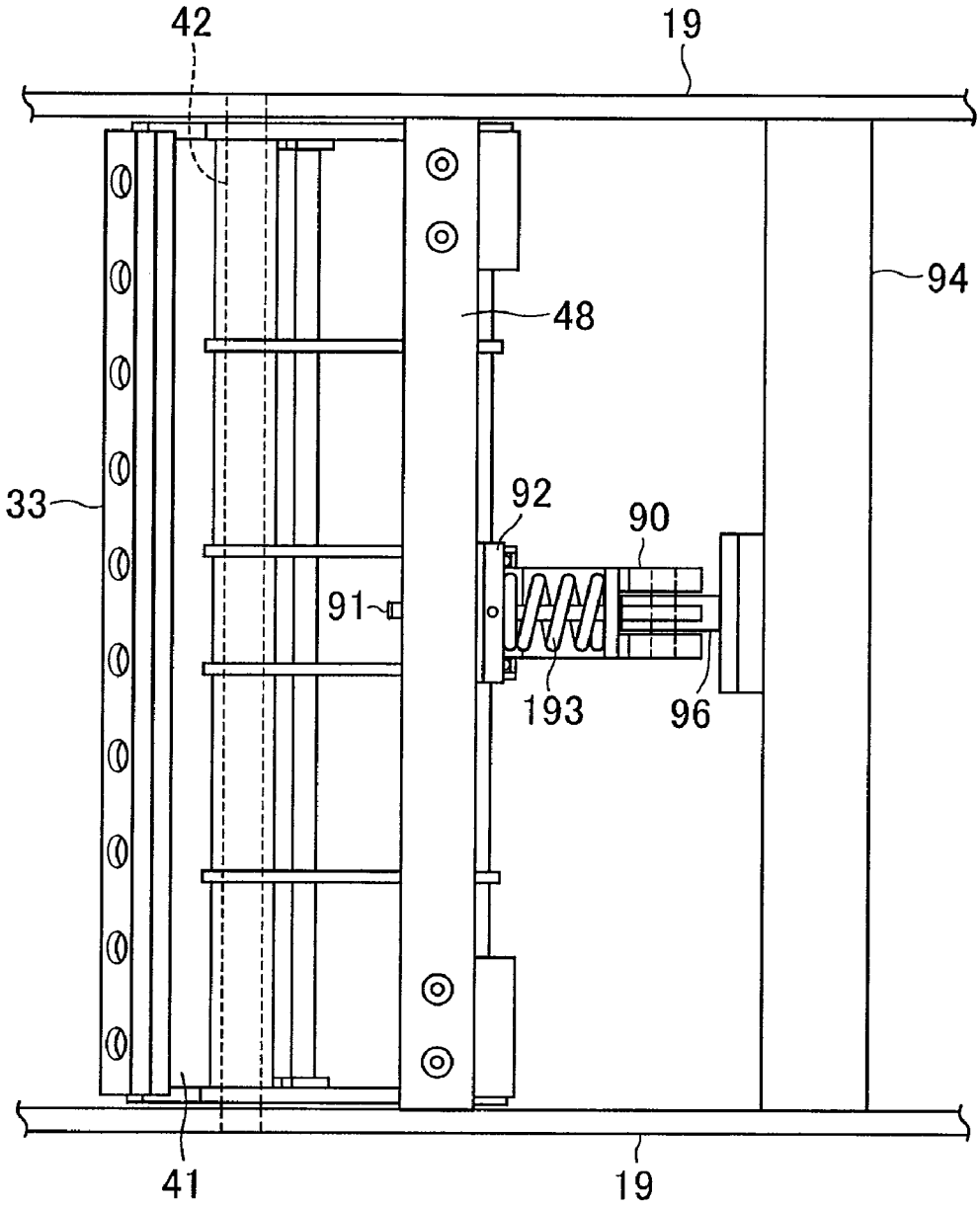
FIG. 9 is a plan view extracting and illustrating a protection device and a housing according to a modification of the first embodiment of the present invention along with peripheral configurations.

Incidentally, the present embodiment is described by taking as an example the case where the rubber spring or urethane spring is used as the elastic member 93 of the protection device 14. However, the invention is not limited to this. For example, as illustrated in FIGS. 8 and 9, a coil spring may be used as the elastic member 193. Also in this case, the same advantage as that of the embodiment described above can be obtained.

In addition, the present embodiment is described by taking as an example the case in which the single protection device 14 is used. However, the invention is not limited to this. For example, the protection device 14 may be provided at each end of the lever support member 94.

Further, the biasing force adjusting means for adjusting the biasing force of the elastic member 93 against the lever 90 is configured to adjust the biasing force by the number or thickness of the shim. However, the invention is not limited to this. For example, an adjusting screw may be provided and turned to adjust the biasing force. Alternatively, the elastic member 93 may be replaced with an elastic member having a different elastic force.

A second embodiment of the present invention will be described with reference to FIGS. 10 to 12.

The present embodiment makes use of a protection member 214 by replacing the protection member 14 of the crushing apparatus 12 illustrated in the first embodiment. In the figures, the same members as in the first embodiment are denoted with like reference numerals and their explanations are appropriately omitted.

Figure 10:
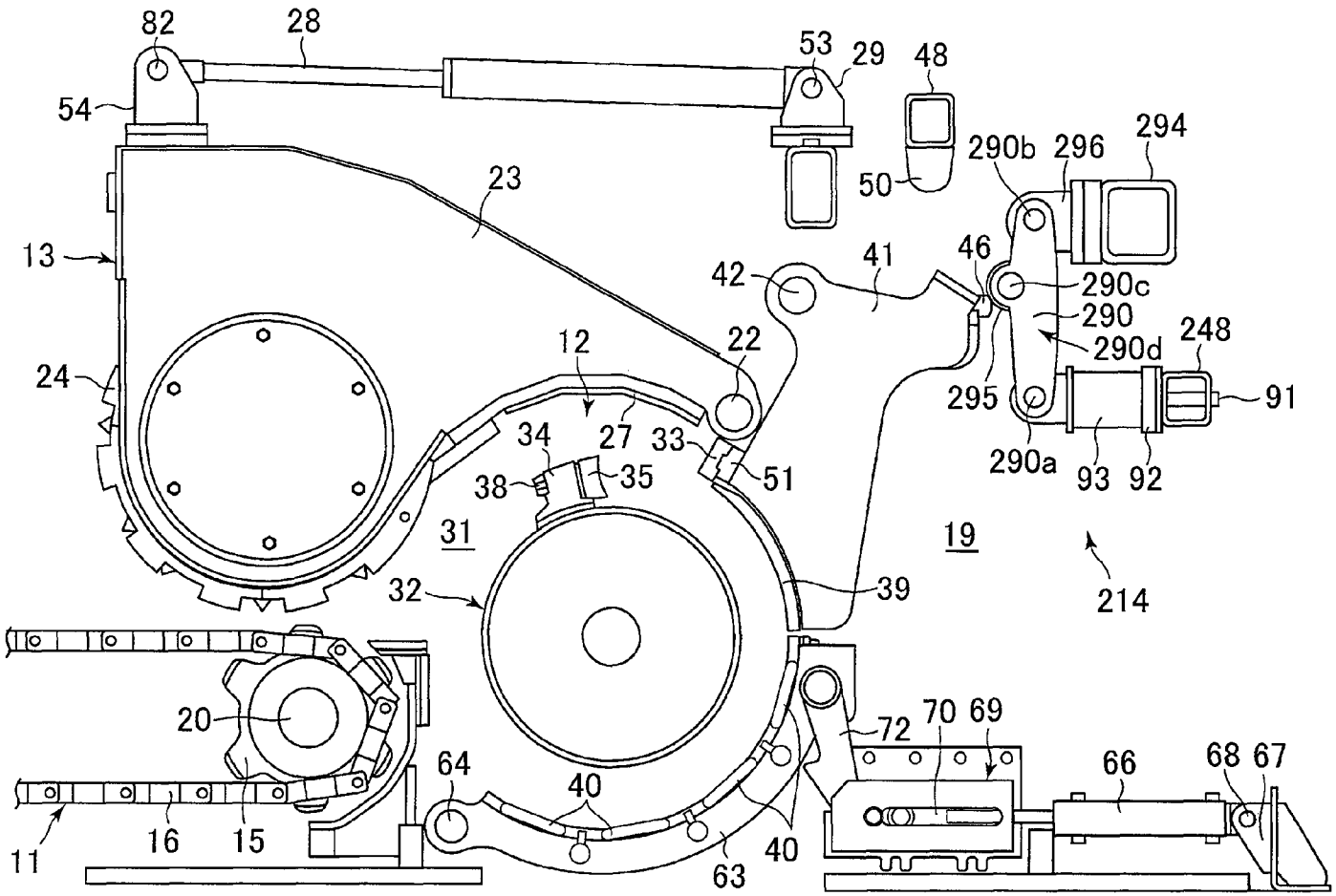
FIG. 10 is a perspective lateral view illustrating detailed structures of the vicinity of a crushing apparatus installed in a self-propelled crusher according to a second embodiment of the present invention, also illustrating a case where the housing lies at a closing position.
Figure 11:
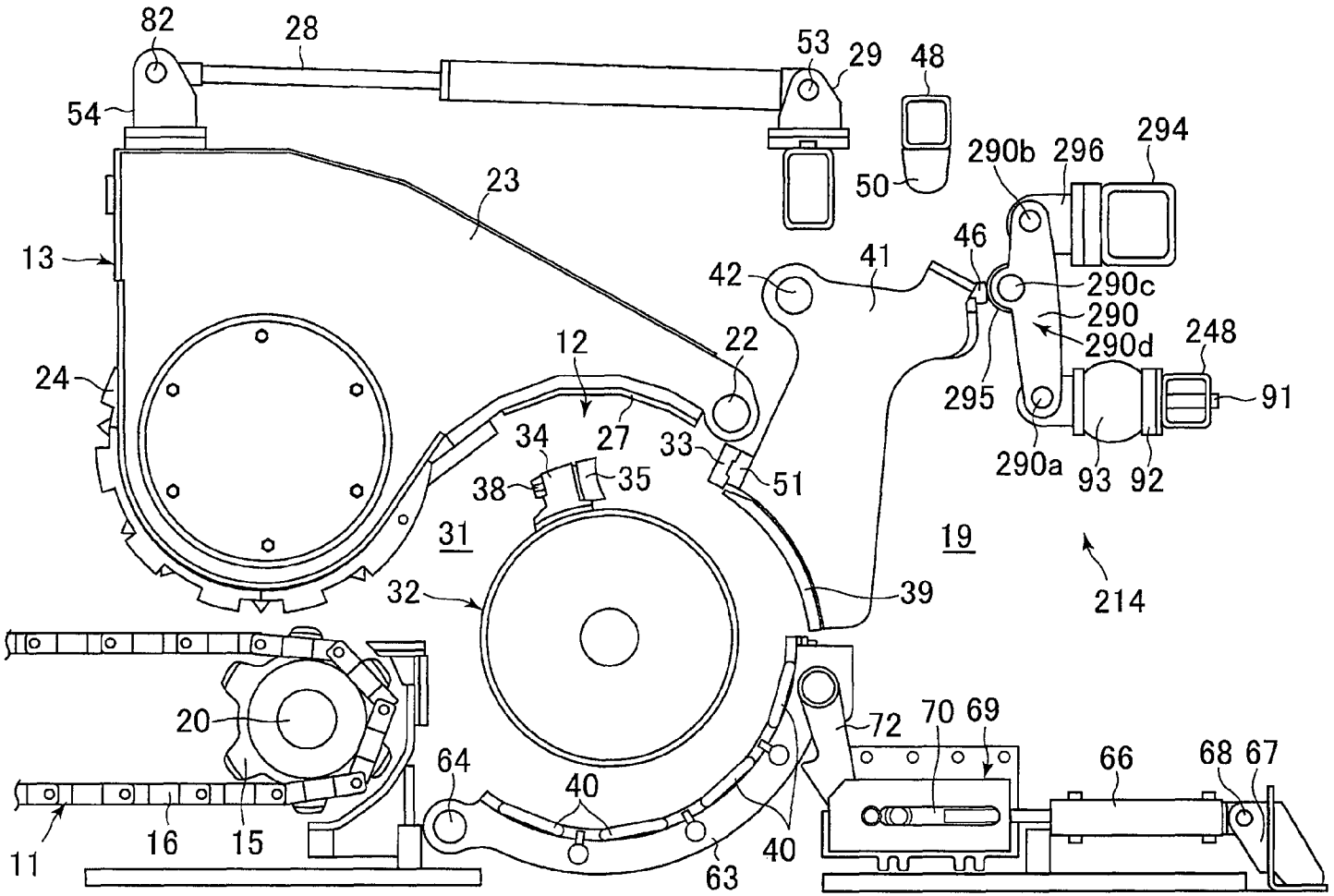
FIG. 11 is a perspective lateral view illustrating detailed structures of the vicinity of the crushing apparatus installed in the self-propelled crusher according to the second embodiment of the present invention, also illustrating a case where the housing is being turning.
Figure 12:
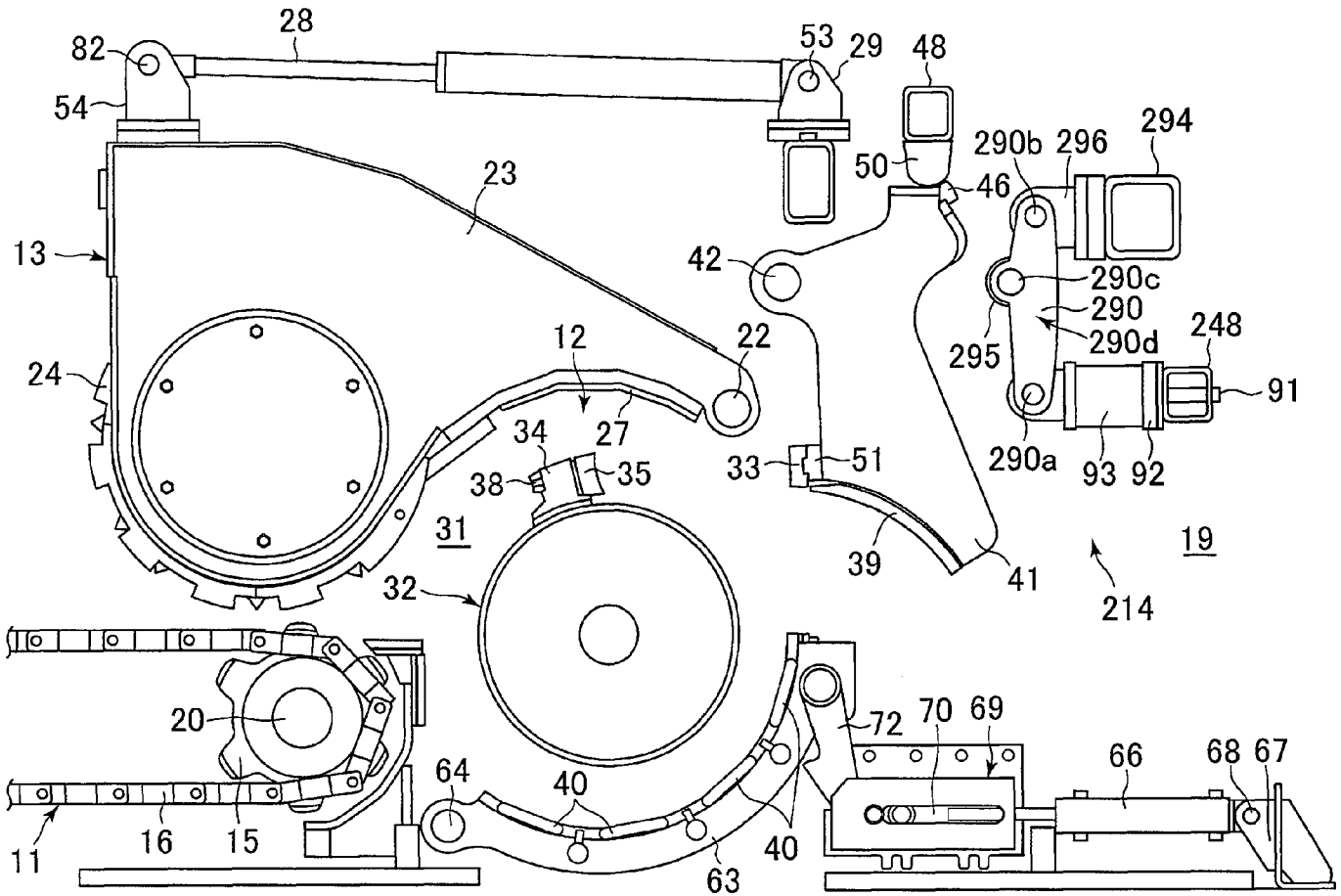
FIG. 12 is a perspective lateral view illustrating detailed structures of the vicinity of the crushing apparatus installed in the self-propelled crusher according to the second embodiment of the present invention, also illustrating a case where the housing lies at an opening position.

FIGS. 10 to 12 are perspective lateral views illustrating detailed configurations in the vicinity of the crushing apparatus 12 in the present embodiment. FIG. 10 illustrates a case where a housing lies at a closing position. FIG. 11 illustrates a case where the housing is being turning. FIG. 12 illustrates a case where the housing lies at an opening position. Incidentally, in the following, directions corresponding to the left and right in FIG. 1 shall be the rear and front, or one and the other, respectively, of the crusher.

The protection device 214 includes a lever bracket 296, a lever 290, a rod 91, a roller 295, a rod support member 248, an elastic member 93 and a shim 92. The lever bracket 296 is mounted to a lever support member 294 disposed along the body-width direction (the direction perpendicular to the sheet surface in the figures) and supported at both ends thereof by the side frames 19. The lever 290 is pivotably mounted to the lever bracket 296 via a pin 290*b*. The rod 91 is pivotably provided via a pin 290*a* at one end of the lever 290 opposite the lever bracket 296. The roller 295 is turnably provided at a projecting portion 290*d*, of a barrel portion of the lever 290, close to the housing 41 via a pin 290*c*. A rod support member 248 disposed along the body-width direction (the direction perpendicular to the sheet surface in the figures) and supported at both ends thereof by the side frames 19. The elastic member 93 is interposed between the lever 290 and the rod support member 248 so as to receive the rod 91 passed therethrough. The shim 92 is inserted between the rod support member 248 and the elastic member 93.

The lever support member 294 is located forward of the housing 41.

The pin 290*c* of the lever 290 is disposed so that a distance between one end close to the pin 290*b* provided with the lever bracket 296 and the pin 290*c* is shorter than a distance between one end close to the pin 290*a* provided with the rod 91 and the pin 290*c*. In this way, force applied to one end close to the pin 290*a* or a point of effort becomes a greater force at the pin 290*c* or a point of load because of the force passing through the pin 290*b* or a fulcrum.

The lever 290 has a projecting portion 290*d*, at its barrel portion, close to the housing 41. The projecting portion 290*d* has a function of a holding portion for holding an engaging portion 46 of the housing 41 to keep a posture where the anvil 33 faces the crushing chamber 31. A roller 295 is provided at the abutment position of this holding portion 290*d* against the engaging portion 46 so as to be turnable via the pin 290*c*. When the engaging portion 46 moves relatively to the holding portion 290*d* of the lever 290, the roller 295 rolls on the engaging portion 46 to reduce the friction force occurring between the holding portion 290*d* and the engaging portion 46.

The rod 91 is pivotably provided via the pin 290*a* at one end of the lever 290 on the side opposite the lever bracket 296 and is insertably fitted to the rod support member 248 secured to the side frames 19, 19. The rod support member 248 is disposed forward of the housing 41 and below (downward in FIG. 10) the lever support member 294. The rod 91 extends from the pin 290*a* of the lever 290 in the direction of the rod support member 248.

During the crushing work (in the state illustrated in FIG. 10), the housing 41 is such that the engaging portion 46 is fixed and held at a closing position by the holding portion 290*d* of the lever 290 of the protection device 214 mounted to the side frames 19, i.e., in the posture where the anvil 33 is disposed in the vicinity of the rotational trajectory of the crushing bit 35. In this case, the roller 295 provided on the holding portion 290*d* of the lever 290 presses rearward the engaging portion 46 of the housing 41 by the biasing force of the elastic member 93 transmitted via the lever 290. When the force of the engaging portion 46 pressing the roller 295 forward exceeds the biasing force of the elastic member 93 transmitted to the roller 295 via the lever 290, the lever 290 is turned to shift forward the roller 295 provided on the holding portion 290*d*. As a result, the engaging portion 46 of the housing 41 rides across the roller 295 to permit the turning of the housing 41. With such a configuration, if an excessive impactive force is applied to the anvil 33, the lever 290 of the protection device 214 is turned in an opening direction (counterclockwise in FIG. 10) to release the restraint of the engaging portion 46 by the holding portion 290*d*. The housing 41 is turned around the pivot shaft 42 to allow the anvil 33 to retreat from the crushing chamber 31. Thus, components of the crusher including the anvil 33 can be prevented from being damaged. In this case, even after the anvil 33 has been retreated from the crushing chamber 31 by the excessive load in this embodiment as illustrated in FIG. 12, by depressing from above the engaging portion 46 of the housing 41 by means of e.g., a cylinder, a manual jack, a hand or the like, the posture of the housing 41, i.e., the position of the anvil 33 with respect to the crushing chamber 31 can be returned to the state shown in FIG. 10. A stopper 50 is mounted to a stopper support member 48 secured to the side frames 19. This stopper 50 limits the turning range of the housing 41 in the opening direction (counterclockwise in FIG. 10) thereof. Thus, the housing 41 and the other constituent elements can be prevented from interfering with each other.

The other configurations in the present embodiment are the same as those of the first embodiment.

A description is given of the operation of the embodiment configured as above.

During the crushing work, in the event that the crushing bit 35 and the anvil 33 hold a foreign object such as a stone, metal or the like, an excessive load is applied from the crushing bit 35 to the anvil 33 and transmitted to the holding portion 290*d* of the lever 290 of the protection device 214 via the engaging portion 46 of the housing 41.

In the event that the excessive impactive force is applied to the anvil 33, the lever 290 of the protection device 214 is turned in the opening direction (counterclockwise in FIG. 10) to release the restraint of the engaging portion 46 by the holding portion 290*d*. Because of the configuration of the protection device 14 as mentioned above, the housing 41 and the anvil 33 are turned around the pivot shaft 42 with respect to the side frames 19 to retreat from the crushing chamber 31. Thus, components of the crusher including the anvil 33 are prevented from being damaged.

The hopping impactive force of the housing 41 encountered when the housing 41 is turned and retreated is absorbed by the stopper 50. In addition, the housing 41 is returned to the original position (the closing position) by its own weight. However, when a position sensor not illustrated or the like detects the retreat of the housing 41, the self-traveled crusher stops the operation for crushing the to-be-crushed object, specifically, the carrying-in of to-be-crushed object by the conveyor 11, the rotation of the crushing rotor 32, etc.

Also the present embodiment configured as described above can provide the same advantage as that of the first embodiment.

A third embodiment of the present invention is described with reference to FIGS. 13 to 16.

The present embodiment uses the protection device of the crushing apparatus illustrated in the first embodiment applied to a tub-type self-traveled crusher. In the figures, the same members as in the first embodiment are denoted with like reference numerals and their explanations are omitted.

Figure 13:
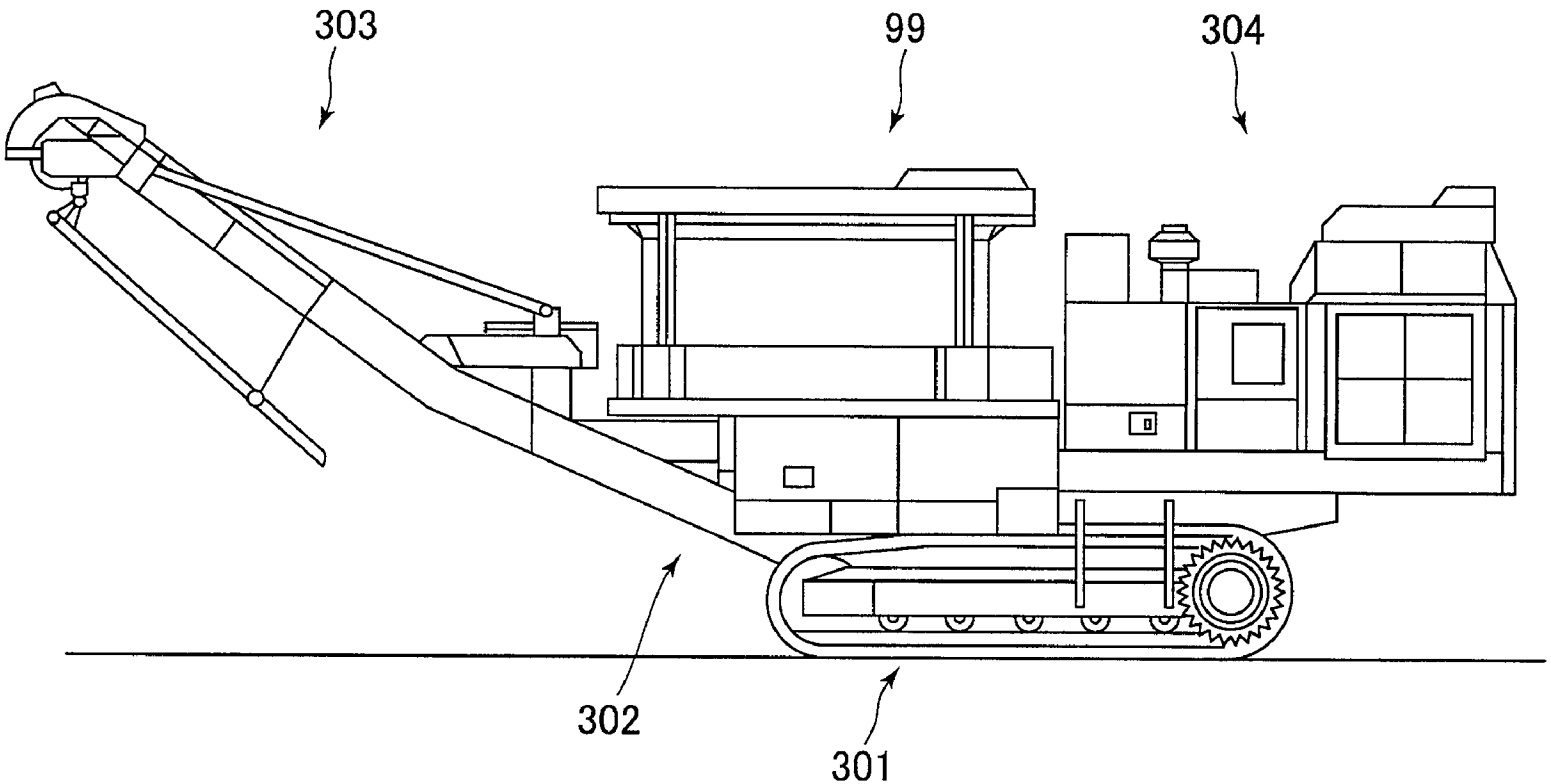
FIG. 13 is a lateral view of an overall structure of a self-propelled crusher according to a third embodiment of the present invention.
Figure 14:
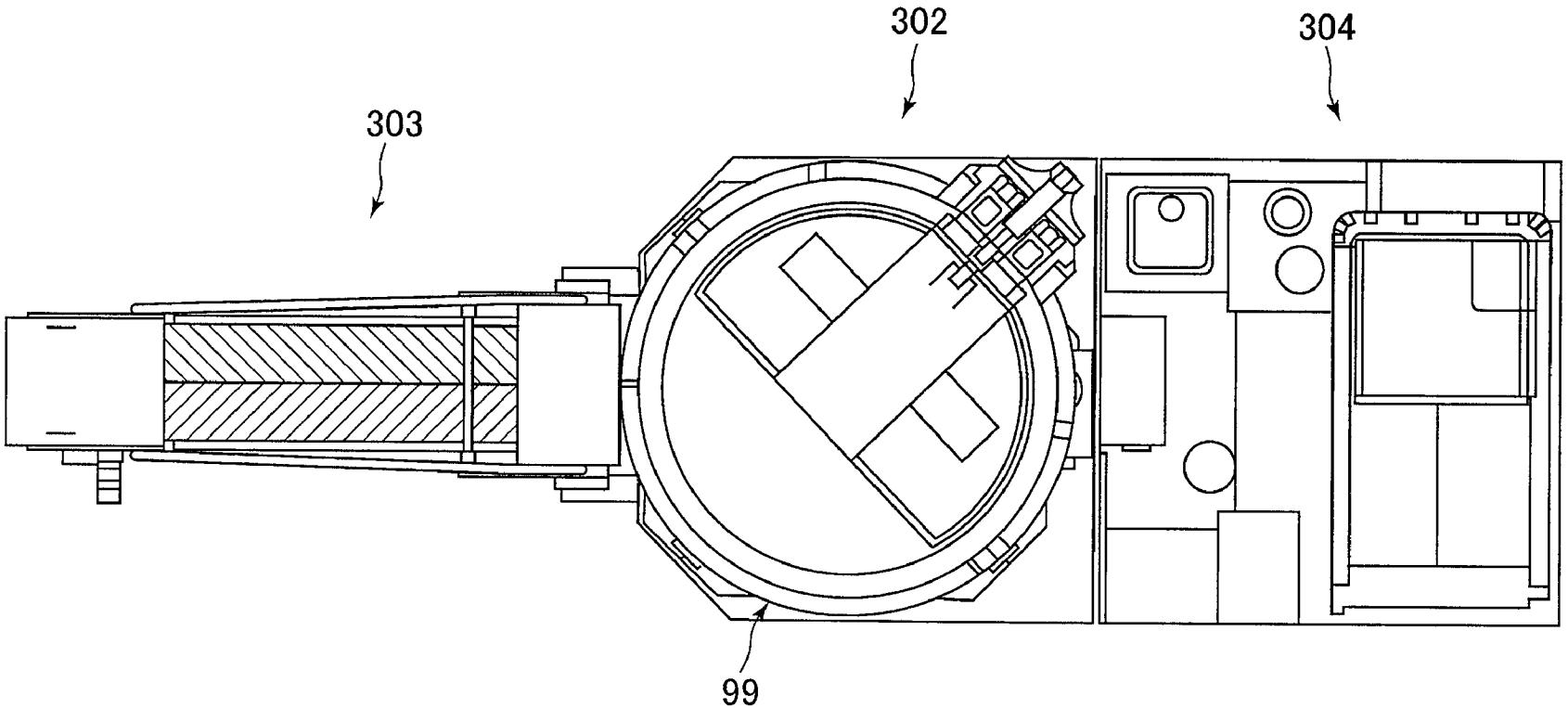
FIG. 14 is a plan view of the overall structure of the self-propelled crusher according to the third embodiment of the present invention.
Figure 15:
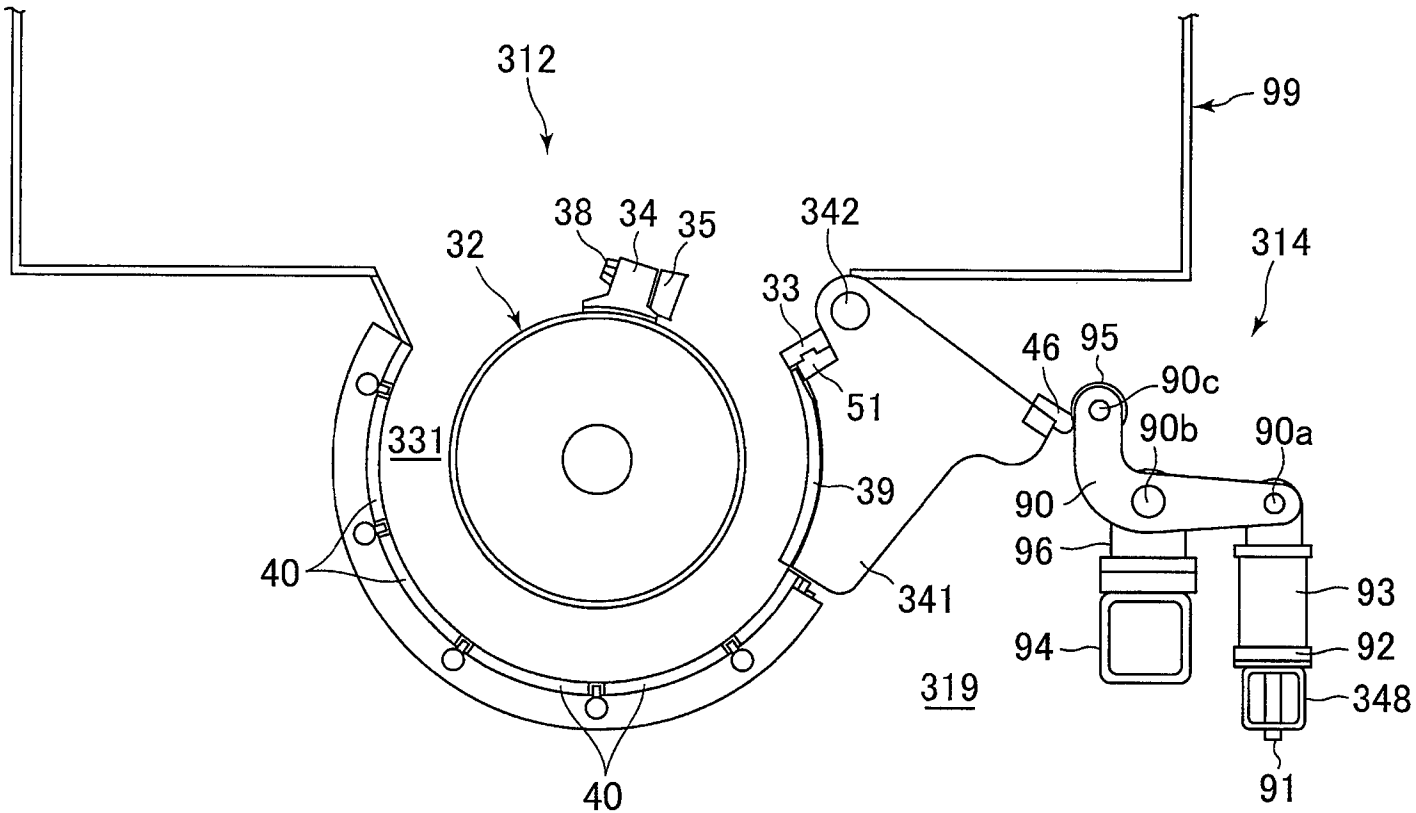
FIG. 15 is a perspective lateral view illustrating detailed structures of the vicinity of the crushing apparatus installed in the self-propelled crusher according to the third embodiment of the present invention, also illustrating a case where the housing lies at a closing position.
Figure 16:
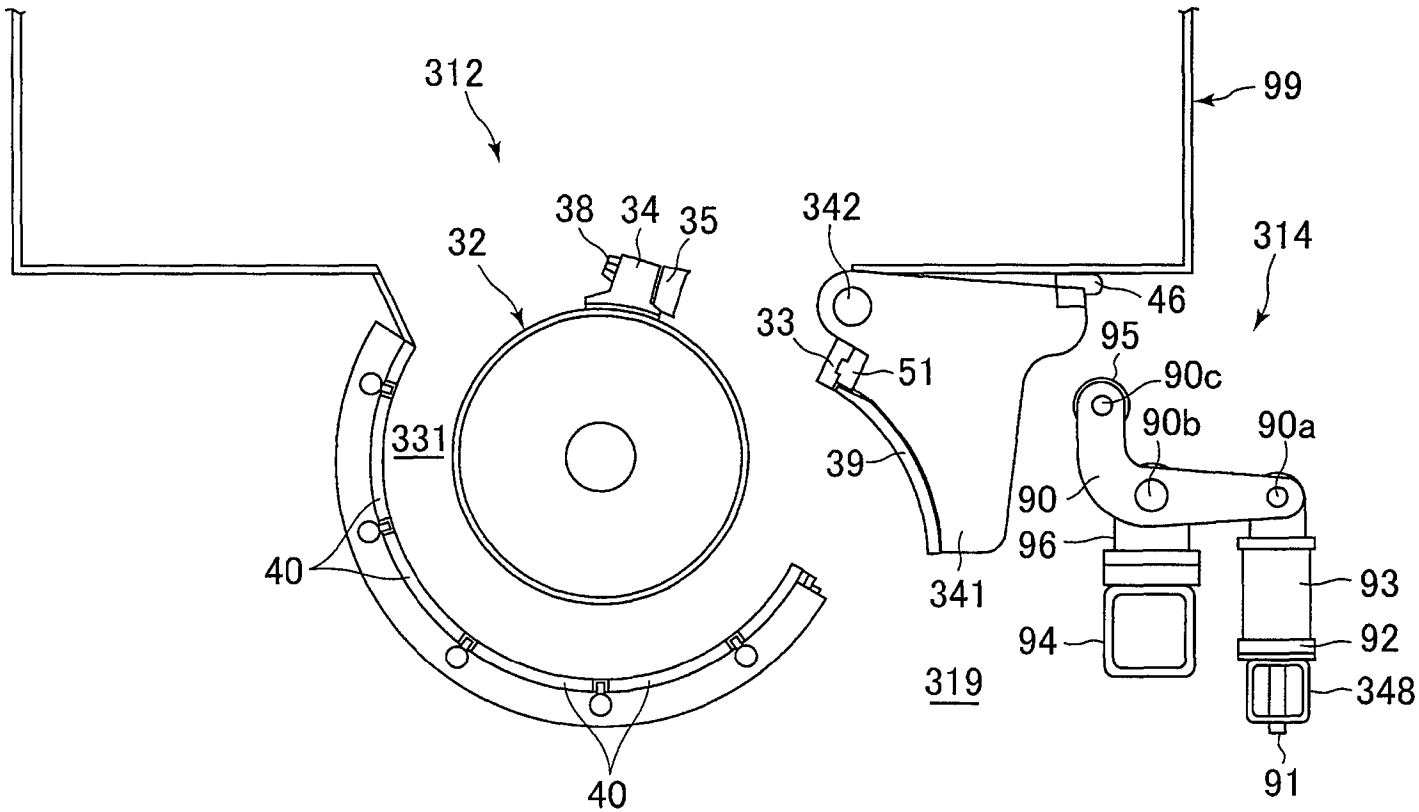
FIG. 16 is a perspective lateral view illustrating detailed structures of the vicinity of the crushing apparatus installed in the self-propelled crusher according to the third embodiment of the present invention, also illustrating a case where the housing lies at an opening position.

FIG. 13 is a lateral view illustrating an overall structure of the self-traveled crusher according to the third embodiment of the present invention. FIG. 14 is a plan view of FIG. 13. FIGS. 15 and 16 are perspective views illustrating a detailed structure in the vicinity of a crushing apparatus 312 installed on the self-traveled crusher illustrated in FIG. 13. FIG. 15 illustrates a case where a housing 41 lies at a closing position. FIG. 16 illustrates a case where the housing 41 lies at an opening position. Incidentally, in the following, directions corresponding to the left and right in FIG. 13 shall be the rear and front, or one and the other, respectively, of the crusher.

In FIGS. 13 and 14, the self-traveling crusher of the present embodiment generally includes: a track body 301 which allows self-propelling; a crushing function constituting portion 302 installed on the track body 301 to crush to-be-crushed object received; a discharge conveyor 303 which conveys the pieces of object crushed by the crushing function constituting portion 302 and discharges them to the outside; and a power arrangement (a power unit) 304 equipped with an engine, etc as a power source for devices mounted on the crusher.

The crushing function constituting portion 302 includes generally cylindrical rotary storing means (rotary tub) 99 and a crushing apparatus 312 (see FIGS. 15 and 16). The storing means 99 is provided at an upper portion (upward in FIG. 1) of the crusher to receive to-be-crushed object from the generally vertical upside, specifically, from an opening portion provided at the upper portion thereof. The crushing apparatus 312 is provided below the rotary tub 99 to crush the to-be-crushed object introduced by the rotary tub 99.

The rotary tub 99 is rotationally driven by a hydraulic motor not illustrated to sequentially introduce a large number of to-be-crushed objects stored therein.

Referring to FIG. 15, the crushing apparatus 312 includes: a crushing rotor 32 rotating at high speeds in a crushing chamber 331; an anvil (fixed blade) 33 provided on the radially outside of the crushing rotor 32; and a protection mechanism 314 for protecting the anvil 33, the crushing rotor 32, etc. The anvil 33, a curved plate 39, and screens (sieves) 40 are provided around the crushing rotor 32 from a portion (the upper portion of the crushing apparatus 312) adapted to receive to-be-crushed object supplied thereto by the rotary tub 99, in the normal-rotational direction of the crushing rotor 32 (the clockwise direction, in the flowing direction of to-be-crushed object in FIG. 15) so as to surround the crushing rotor 32. The crushing chamber 331, a cylindrical space, in which crushed pieces go around the crushing rotor 32, is defined by the anvil 33, the curved plate 39, the screens 40, etc.

The housing 341 holds the anvil 33 at a position close to the crushing chamber 331 and is supported pivotably in the back and forth direction at a position below the rotary tub 99 described earlier with a pivot shaft 342, serving as a fulcrum, supported by bearings (not illustrated) provided on side frames 319 of the self-propelling crusher. In addition, the housing 341 is provided with a projecting portion 46 at an end located forward and obliquely downward (in the rightward downward direction) as viewed from the pivot shaft 342. During normal time period (during the crushing work), the engaging portion 46 of the housing 341 is supported by a holding portion (described later) of a protecting device 314 (described later) mounted on the inner wall surfaces of the side frames 319. In addition, the anvil 33 is held at the closing position (the position illustrated in FIG. 15) facing to-be-crushed object in the crushing chamber 31. During the crushing work, in the event that an excessive load is applied to the anvil 33, the holding portion of the protecting device 314 is shifted to release the restraint of the housing 341. The housing 341 is turned around the pivot shaft 342 to the opening position (the position illustrated in FIG. 16) where the anvil 33 retreats from the crushing chamber 331.

The protection device 314 includes a lever bracket 96, a lever 90, a roller 95, a rod support member 348, a rod 91, an elastic member 93 and a shim 92. The lever bracket 96 is mounted to a lever support member 94 disposed along the body-width direction (the direction perpendicular to the sheet surface in FIG. 15) and secured at each end thereof to the side frame 319. The lever 90 is pivotably mounted to the lever bracket 96 via a pin 90*b*. The roller 95 is turnably provided at one end of the lever 90 close to the housing 41 via a pin 90*c*. The rod support member 348 is disposed along the body-width direction (the direction perpendicular to the sheet surface in FIG. 15) and secured to the side frames 319. The rod 91 is turnably provided at one end of the lever 90 opposite the housing 341 via a pin 90*a*. The elastic member 93 is interposed between the lever 90 and the rod support member 348 so as to receive the rod 91 passed therethrough. The shim 92 is inserted between the lever support member 94 and the elastic member 93.

A portion of the lever 90 extending from the pin 90*b* to the side of the pin 90*c* plays a role of a holding portion. This holding portion is provided at one end close to the housing 41 to hold the engaging portion 46 of the housing 41 to keep a posture where the anvil 33 faces the crushing chamber 31.

The lever support member 94 is disposed forward and downward (the right downward direction in FIG. 15) of the housing 41.

The lever bracket 96 is provided at the general center of the lever support member 94 secured at both ends thereof to the side frames 319, i.e., at a position corresponding to the engaging portion 46 of the housing 341 so as to project upward (the upper direction in FIG. 15) from the lever support member 94.

The rod 91 is pivotably supported via a pin 90*a* at one end of the lever 90 on the side opposite the housing 41 and is insertably fitted into the rod support member 348 secured to the side surfaces 319. The rod support member 348 is disposed on the side opposite the housing 341 with respect to the lever support member 94. The rod 91 extends from the pin 90*a* of the lever 90 toward the rod support member 348.

The other configurations of the present embodiment are the same as those of the first embodiment.

A description is given of the operation of the present embodiment as described above.

To-be-crushed object is fed into the rotary tub 99 by the heavy machine (a hydraulic shovel or the like) equipped with the appropriate working tool such as a grapple. A large number of the to-be-crushed objects stored inside the rotary tub 99 are introduced into the crushing apparatus 312 by the rotation of the rotary tub 99.

The crushing bits 35 of the crushing rotor 32 rotating at high speed collide with the to-be-crushed object introduced into the crushing chamber 331, thereby roughly crushing that into crushed pieces. The crushed pieces collide with the anvil 33 to be more finely crushed by the impactive force. Also thereafter, the crushed pieces go-around in the crushing chamber 331 along with the rotation of the crushing rotor 32 and collide with and are crushed by the crushing bits 35, the anvil 33, the inner wall of the crushing chamber 31, etc. Of the circulating crushed pieces, crushed pieces that are made finer into such a size as to pass through the discharge holes of the screens 40 sequentially pass through the screens 40 and are discharged from the crushing chamber 331. The crushed pieces discharged from the crushing chamber 331 drop onto the discharge conveyor 303 to be conveyed and discharged to the outside of the crusher.

When the crushing work mentioned above is carried out, the crushing bit 35 and the anvil 33 may hold therebetween a foreign object such as a stone, metal or the like. In such an event, an excessive load is applied from the crushing bit 35 to the anvil 33 and transmitted to the holding portion of the lever 90 of the protection device 314 via the engaging portion 46 of the housing 341.

In the event that the excessive impactive force is applied to the anvil 33, the lever 90 of the protection device 314 is turned in the opening direction (counterclockwise in FIG. 15) to release the restraint of the engaging portion 46 by the holding portion. Because of the configuration of the protection device 314 as mentioned above, the housing 341 and the anvil 33 are turned around the turning shaft 342 with respect to the side frames 319 to retreat from the crushing chamber 331. Thus, components of the crusher including the anvil 33 are prevented from being damaged.

The hopping impactive force of the housing 341 encountered when the housing 341 is turned and retreated is absorbed by the stopper not illustrated. In addition, the housing 341 is returned to the original position (the closing position) by its own weight. However, when a position sensor not illustrated or the like detects the retreat of the housing 341, the self-traveled crusher stops the operation for crushing the to-be-crushed object, specifically, the carrying-in of to-be-crushed object by rotation of the rotary tab 99, the rotation of the crushing rotor 32, etc.

The present embodiment configured as described above can provide the same advantage as that of the first embodiment.

Incidentally, the present embodiment describes the case where the protection device of the first embodiment is used for the tub-type crusher by way of example. However, the invention is not limited to this. The protection device of the second embodiment may be used. Also such a case can provide the same advantage as that of the first embodiment.

A fourth embodiment of the present invention will be described with reference to FIGS. 17 to 26.

The present embodiment makes use of an engaging portion 446 and a protection device 414 in place of the engaging portion 46 and the protection device 14, respectively, illustrated in the first embodiment. An amount of engagement (described later) between the engaging portion 446 and the protection device 414 which holds the engaging portion 446 to keep the posture of the housing 441 at the closing position is adjusted to adjust a frequency in which a housing 441 is turned to retreat the anvil 33 from a crushing chamber 31.

The details of the present embodiment are hereinafter described with reference to the drawings. In the figures, the same members as in the first embodiment are denoted with like reference numerals and their explanations are appropriately omitted.

Figure 17:
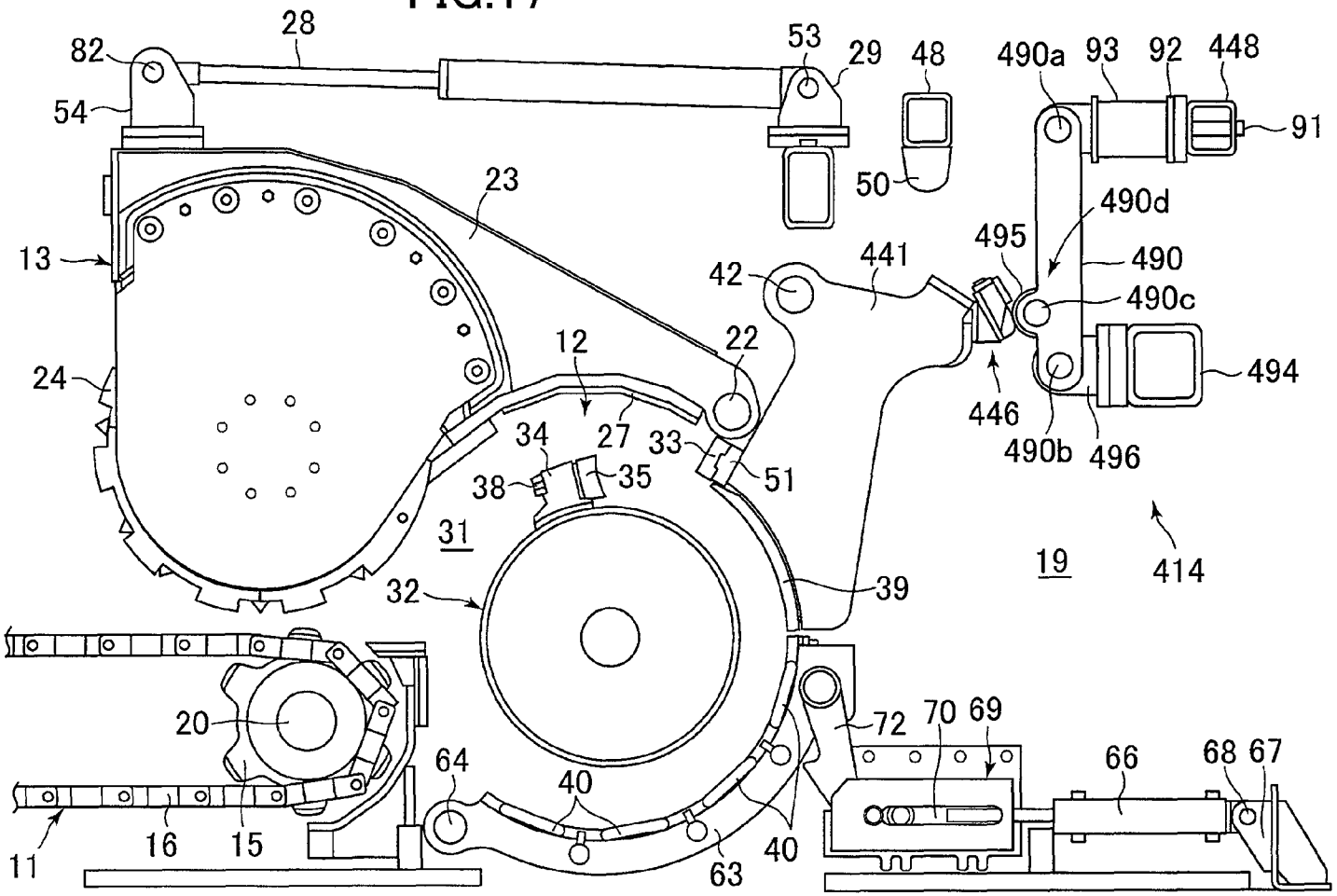
FIG. 17 is a perspective lateral view illustrating detailed structures of the vicinity of a crushing apparatus installed in a self-propelled crusher according to a fourth embodiment of the present invention, also illustrating a case where the housing lies at the closing position.
Figure 18:
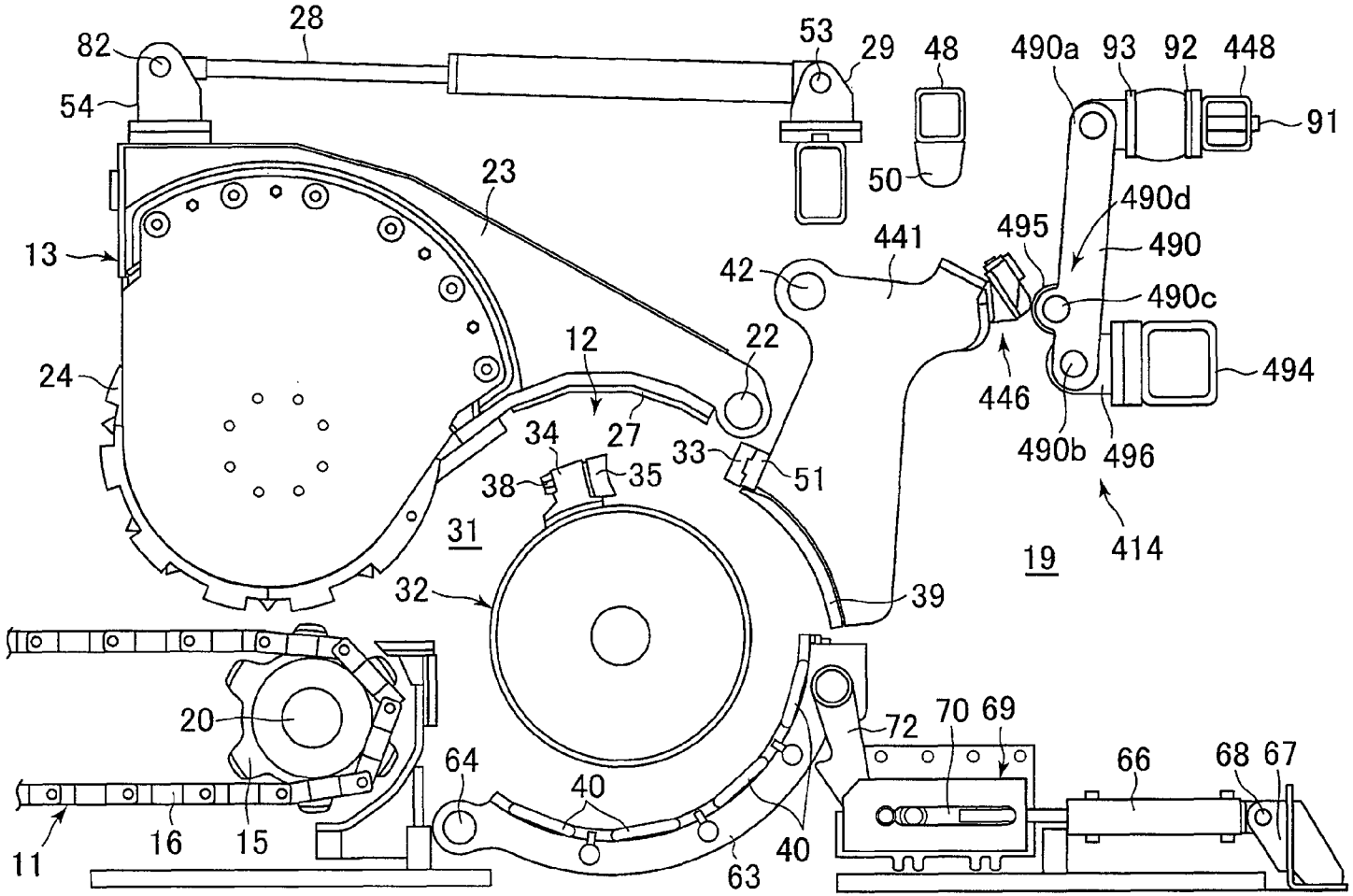
FIG. 18 is a perspective lateral view illustrating detailed structures of the vicinity of the crushing apparatus installed in the self-propelled crusher according to the fourth embodiment of the present invention, also illustrating a case where the housing is being turning.
Figure 19:
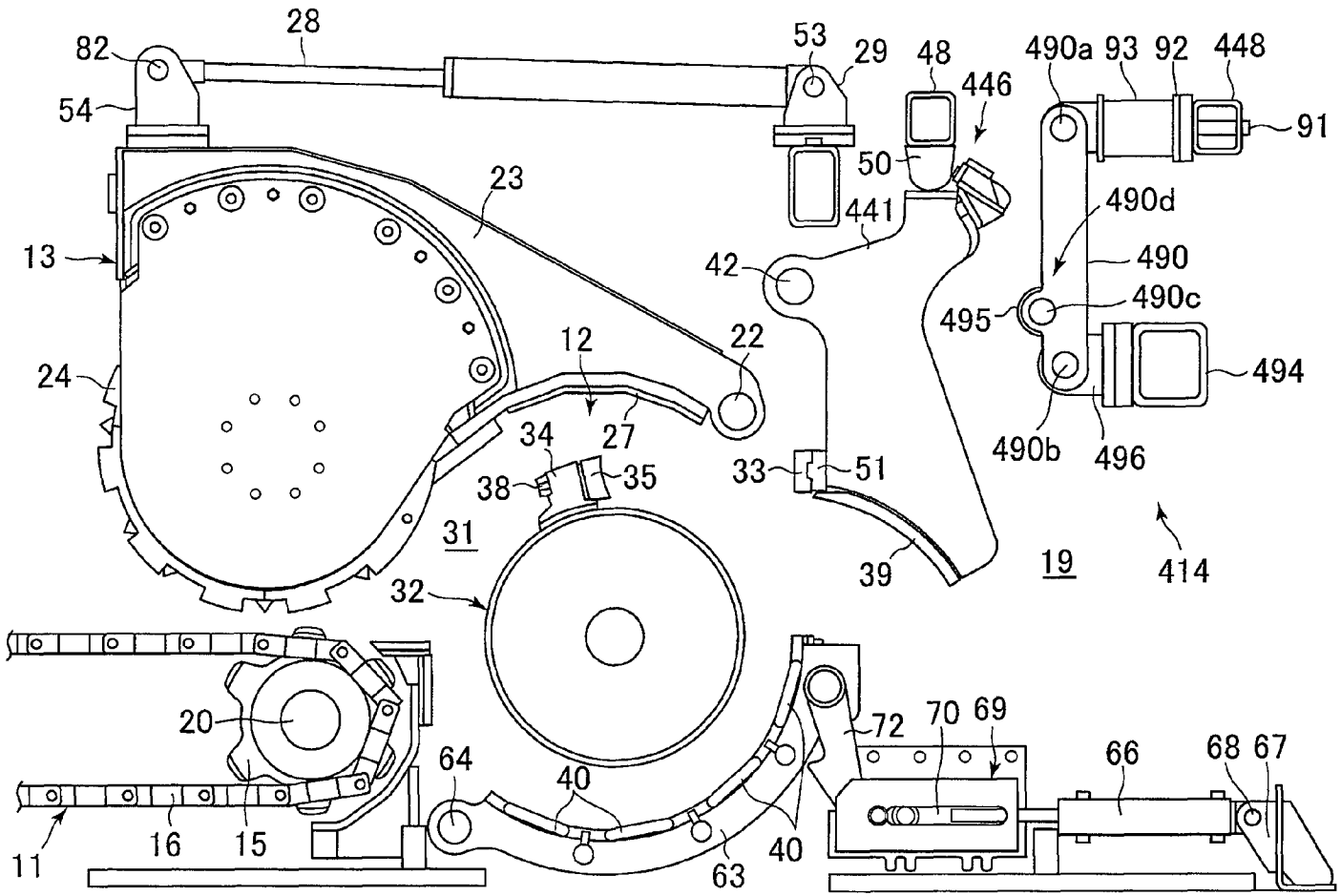
FIG. 19 is a perspective lateral view illustrating detailed structures of the vicinity of the crushing apparatus installed in the self-propelled crusher according to the fourth embodiment of the present invention, also illustrating a case where the housing lies at an opening position.

FIGS. 17 to 19 are perspective lateral views illustrating a detailed structure in the vicinity of a crushing device 12 installed in a self-traveled crusher according to the present embodiment. FIG. 17 illustrates a case where the housing 441 lies at a closing position as a position during crushing work. FIG. 18 illustrates a case where the housing 441 is being turning from the closing position to the opening position. FIG. 19 illustrates a case where the housing 441 lies at an opening position as a retreat position of the anvil 33. Incidentally, like the first embodiment, directions corresponding to the left and right in FIGS. 1 and 2 shall be the rear and front, or one and the other, respectively, of the crusher.

In FIGS. 17 to 19, the housing 441 holds the anvil 33 on the side of a crushing chamber 31. The housing 441 is supported above the pivot shaft 22 of the pressing roller device 13 described earlier so as to be turnable in the back and forth direction with the pivot shaft 42, serving as a fulcrum, supported by bearings not illustrated provided on the side frames 19. In addition, the housing 41 is provided with an engaging portion 446 (described later) at its front end portion extending forward as viewed from the pivot shaft 42. The housing 441 is formed so that a distance from the pivot shaft 42 or a fulcrum to the anvil 33 as a point of effort may be generally equal to a length (distance) from the pivot shaft 42 to the engaging portion 446 or a point of load. Thus, the same load as that applied to the anvil 33 is applied to the engaging portion 446. Incidentally, as described in the first embodiment, the length (distance) from the pivot shaft 42 to the engaging portion 446 may be increased or reversely reduced compared with the length from the pivot shaft 42 of the housing 441 to the anvil 33.

During the normal time period (during crushing work), the engaging portion 446 of the housing 441 is supported by a holding portion 490*d* (described later) of a protection device 414 provided on the inner wall surface of the side frames 19. In addition, the anvil 33 is held at a closing position (the position indicated in FIG. 17) opposed to the to-be-crushed object in the crushing chamber 31. During the crushing work, if an excessive load is applied to the anvil 33, a load generally equal to such an excessive load is applied to the protection device 14 to shift forward the holding portion 490*d* of the protection device 14. This releases the restraint of the engaging portion 446 of the housing 41 (see FIG. 18). Consequently, the housing 441 is turned around the pivot shaft 42 to an opening position (the position illustrated in FIG. 19) where the anvil 33 retreats from the crushing chamber 33.

In the following, the forward displacement of the holding portion 490*d* required to release the restraint of the engaging portion 446 is referred to as the engaging amount.

A detailed description is now given of the engaging portion 446 and the protection device 414 with reference to FIGS. 20 to 26.

Figure 20:
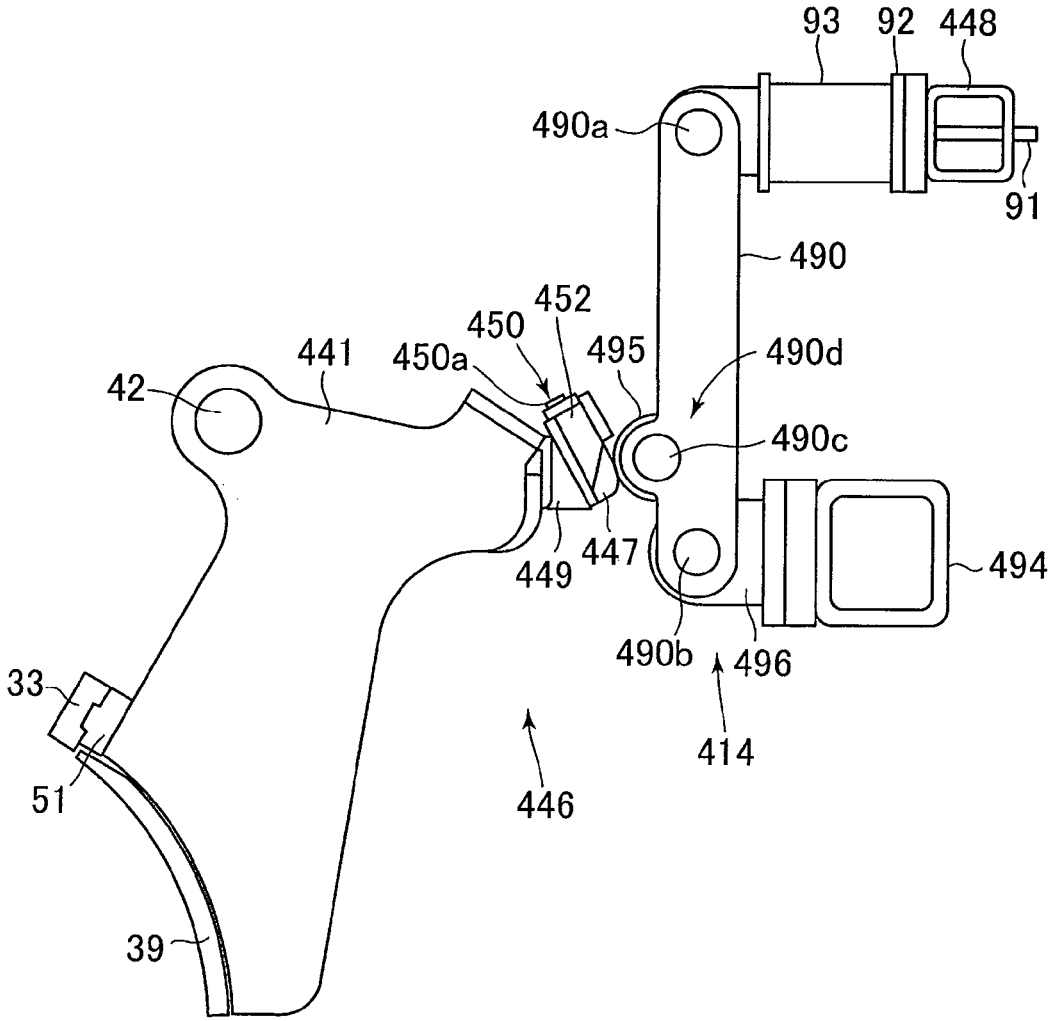
FIG. 20 is a lateral view extracting and illustrating the housing, an engaging portion thereof and a protection device as well as peripheral configurations according to the fourth embodiment of the present invention, also illustrating a case where the housing lies at the closing position.
Figure 21:
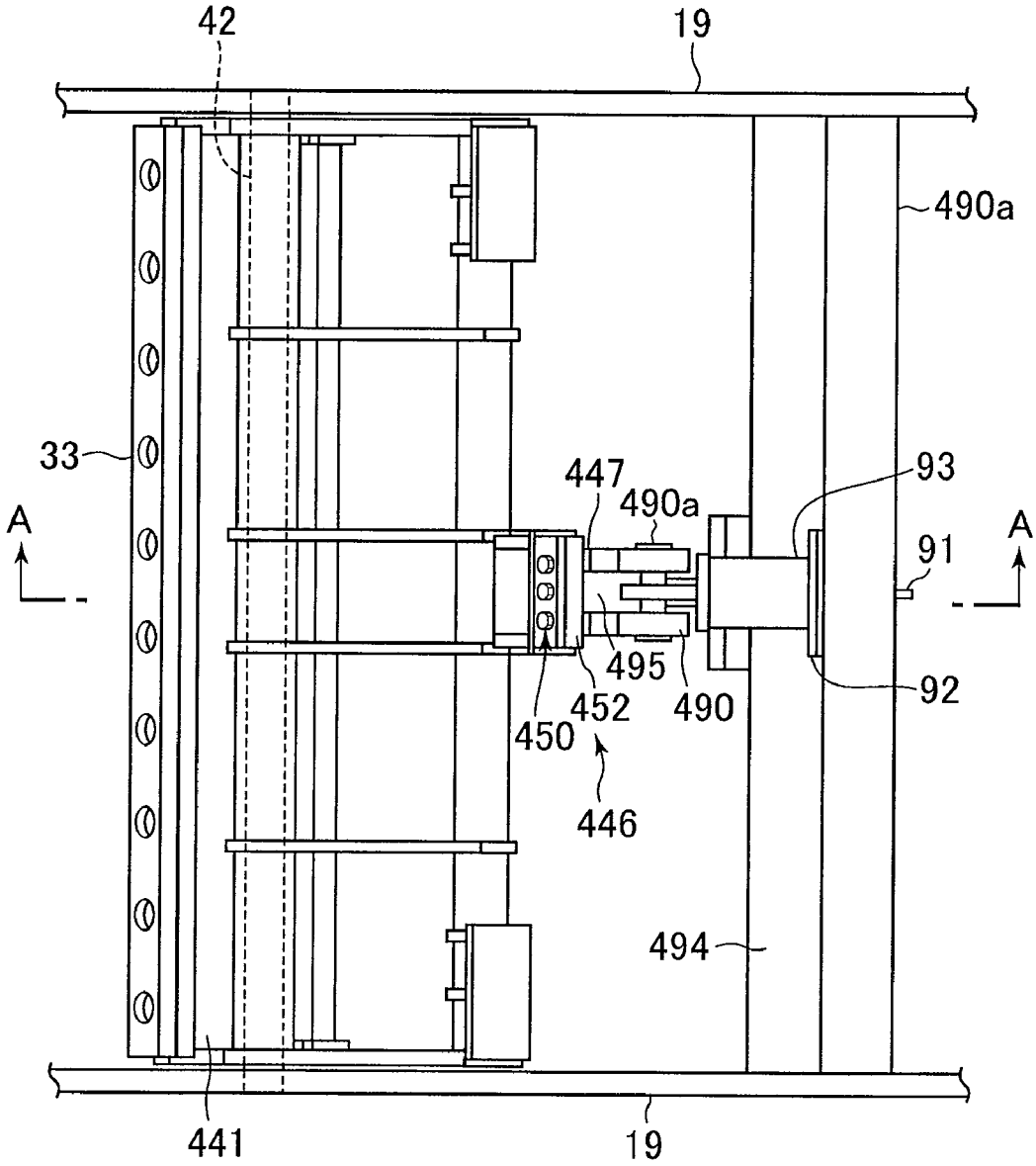
FIG. 21 is a plan view extracting and illustrating the housing and the protection device as well as peripheral configurations according to the fourth embodiment of the present invention.
Figure 22:
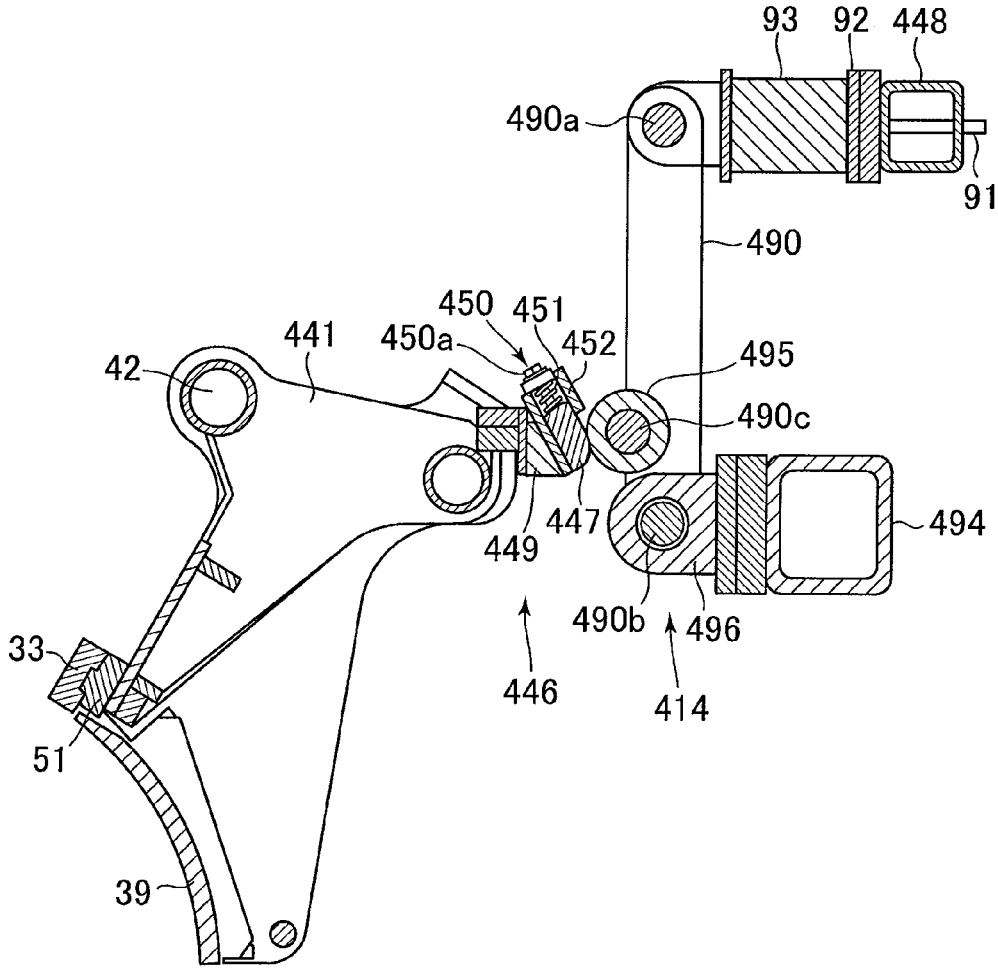
FIG. 22 is a cross-sectional view taken along line A-A of FIG. 21.

FIG. 20 is a lateral view extracting and illustrating the housing 441 lying at the closing position, its engaging portion 446, and the protection device 414 as well as their peripheral configurations. FIG. 21 is a plan view extracting and illustrating the housing 441 and protection device 414 shown in FIG. 20 as well as their peripheral configurations. FIG. 22 is a cross-sectional view taken along line A-A shown in FIG. 21. Incidentally, the left and right directions in FIG. 21 correspond to the rear and front directions, respectively, of the self-traveled crusher illustrated in FIGS. 1 and 2.

Referring to FIGS. 20 to 22, the engaging portion 446 includes: a latch 447 in abutment against the holding portion 490*d* of the protection device 414; a case 452 holding the latch 447 in a state where its portion abutted against the holding portion 490*d* is projected; and a base portion 449 adapted to secure the case 452 to the housing 441.

The case 452 has an opening portion from which the latch 447 projects toward the protection device 414. The case 452 is arranged as below. The opposite side of the opening portion, i.e., the back side of the opening portion in the case 452 (hereinafter described as the back side) is oriented in the turning-retreat direction of the housing 441. Further, the case 452 is inclined with respect to the turning-retreat direction so that the opening portion side is located more far away from the pivot shaft 42 as the turning center of the housing 441 than the back side. In other words, in the case where the housing 441 lies at the closing position (see FIG. 20), the case 452 is arranged such that the back side is oriented rearward and obliquely upward (leftward and obliquely upward in FIG. 20) and the opening portion side is oriented forward and obliquely downward. Of a wall surface of the case 452 extending on the opening portion side, a wall surface on the side of the housing 441 is formed longer than that on the side of the holding portion 490*d*.

The latch 447 is held along the wall surface on the side of the housing 441 and of the holding portion 490*d* in the case 452 so as to be slidable in the back direction and in the opening portion direction (movable forward and rearward). An amount of projection of the latch 447 from the opening portion of the case 452 is adjusted by sliding the latch 447 with respect to the case 452. One end of the latch 447 close to the opening portion of the case 452 is curved from a side of the case 452 close to the holding portion 490*d* to an end face (the face formed toward the sliding direction) of the case 452 close to the opening portion.

When the housing 441 lies at the closing position, the latch 447 is abutted against the holding portion 490*d* at its horizontal direction with respect to the sliding direction thereof. In addition, the latch 447 is pressed against the wall surface of the case 452 close to the housing 441. In this case, since a force applied from the holding portion 490*d* to the latch 447 is vertical to the slidable direction of the latch 447, a friction force occurs between the latch 447 and the wall surface of the case 452 close to the housing 441. This suppresses the sliding of the latch 447 with respect to the case 452 resulting from the latch 447 pressed by the holding portion 490*d*. The contact point between the holding portion 490*d* and the latch 447 may coincide with the curved portion of the latch 447. Also in such a case, a component, vertical to the sliding direction of the latch 447, of the force applied from the holding portion 490*d* to the latch 447 causes a friction force between the latch 447 and the wall surface of the case 452 close to the housing 441.

The latch 447 is provided with a bolt hole (not illustrated) at one end on the back side of the case 452. This bolt hole is formed with an internal thread portion on the inner circumferential portion. Bolts 450 provided on the outer circumference of its barrel portion (not illustrated) with an external thread portion threadedly engaged with the corresponding bolt holes are inserted in the direction along the sliding direction of the latch 447. In the present embodiment, a plurality of (e.g. three) bolts 450 are arranged side by side in the left-right direction (the vertical direction in FIG. 21) at one end of the latch 447 on the back side.

The bolts 450 are slidably passed through respective through-holes (not illustrated) provided at one end of the case 452 on the back side. The bolts 450 are each arranged such that its head 450*a* formed to have a diameter greater than that of the through-hole is located externally of the case 452. Thus, the latch 447 and the bolt 450 integrally slide with respect to the case 452. In addition, the bolt 450 limits the range where the latch 447 is slidable in the direction of the opening portion of the case 452. Such a range is determined depending on the distance between the head 450*a* of the bolt 450 and the latch 447. In this way, the bolt 450 is turned to adjust the amount of insertion of the latch 447 into the bolt hole. Thus, the adjustment is carried out by changing the distance between the head 450*a* of the bolt 450 and the latch 447.

In FIG. 22, a spring 451 interposed between the case 452 and the latch 447 is provided in the case 452 so as to receive the bolt 450 passed therethrough. The latch 447 is biased in the opening portion side of the case 452 by the spring 451 and is disposed at one end of the slidable range on the opening portion side.

Figure 23:
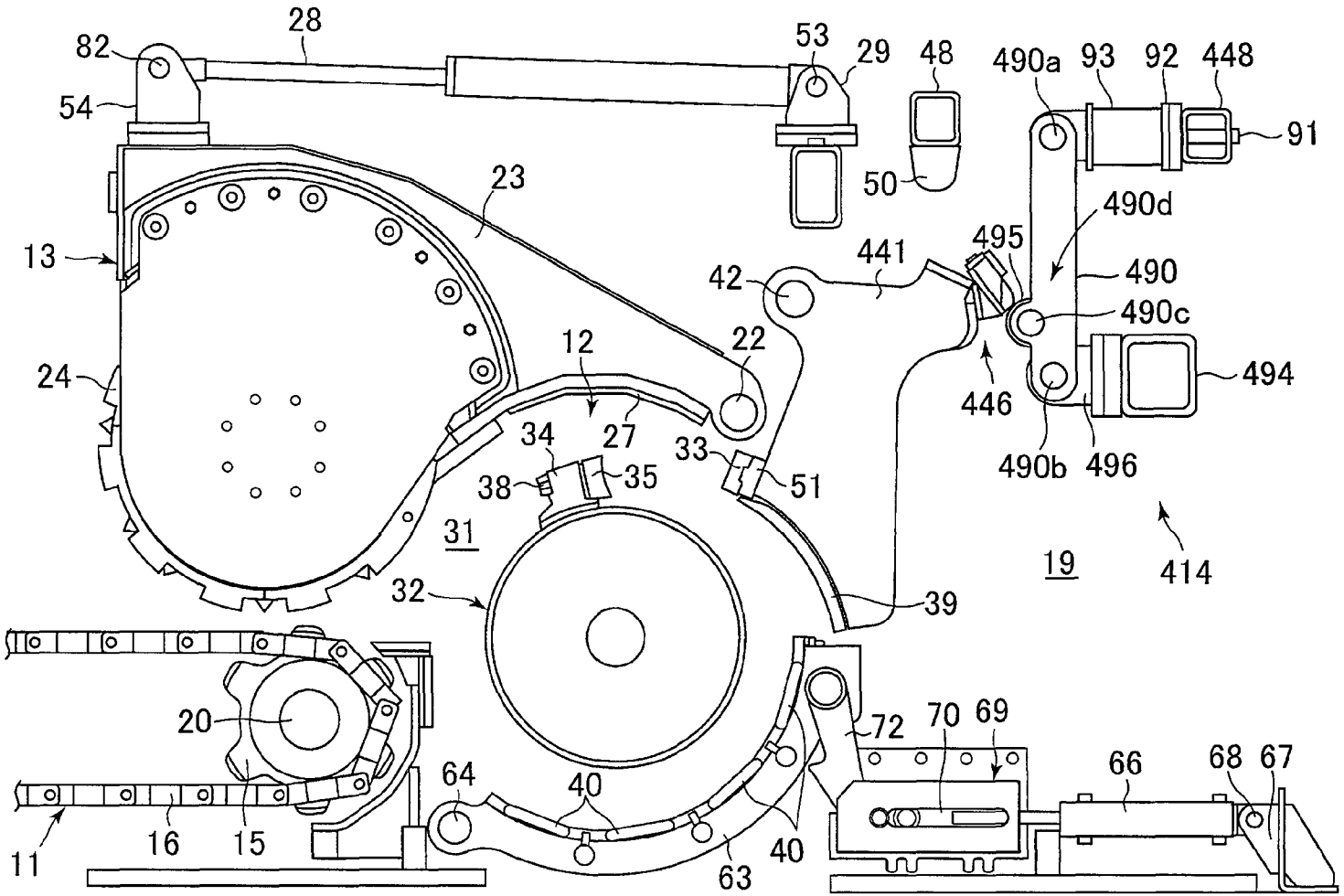
FIG. 23 is a perspective lateral view illustrating a detailed configuration in the vicinity of a crushing apparatus according to the fourth embodiment of the present invention, also illustrating a condition immediately after contact between a latch and a holding portion during the restoring work of the house.
Figure 24:
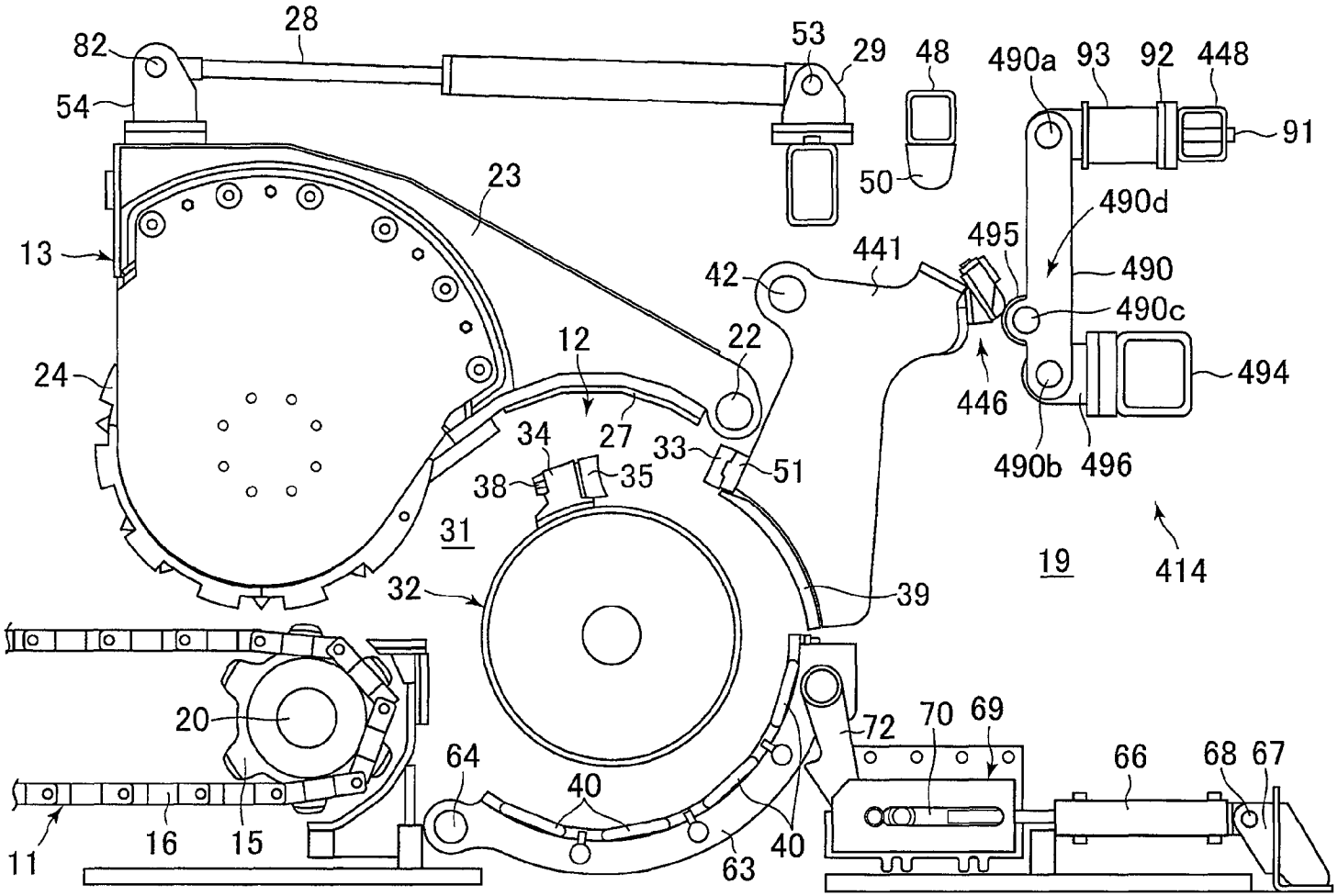
FIG. 24 is a perspective lateral view illustrating the detailed configuration in the vicinity of the crushing apparatus according to the fourth embodiment of the present invention, also illustrating conditions in the restoring work of the housing.

When the force applied to the latch 447 from the opening portion side of the case 452 in the sliding direction of the latch 447 exceeds the biasing force of the spring 451, the latch 447 is slid in the back side of the case 452. As such a case, FIGS. 23 and 24 illustrate the case where the housing 441 is brought (returned) from the opening position to the closing position. FIG. 23 illustrates the state where the latch 447 comes into contact with the holding portion 490*d*. FIG. 24 illustrates the state where the housing 441 is further shifted to the closing position side from the position illustrated in FIG. 23. In FIGS. 23 and 24, as the housing 441 is shifted from the opening position direction to the closing position direction, the latch 447 is slid toward the back side of the case 452. Thus, the projecting amount of the latch 447 toward the protection device 414 is temporarily reduced.

Figure 25:
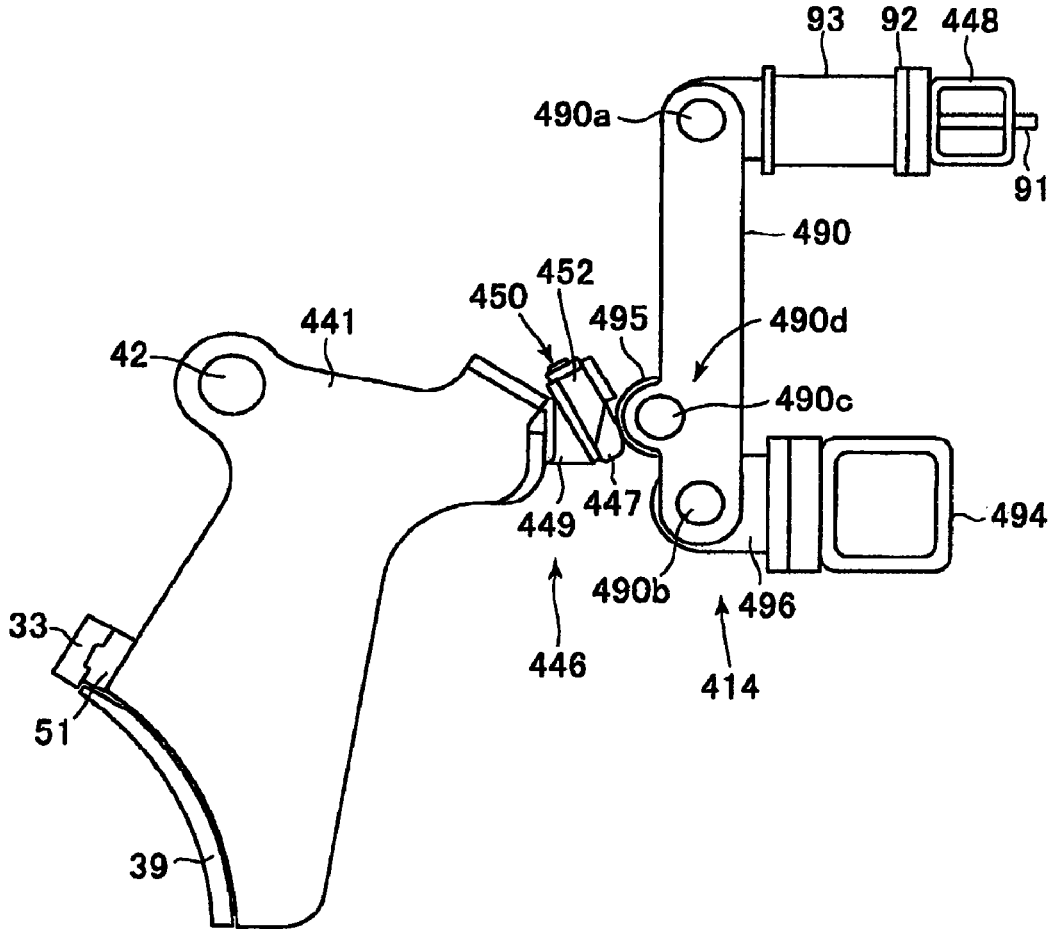
FIG. 25 is a lateral view extracting and illustrating the housing, the engaging portion thereof and the protection device as well as the peripheral configurations according to the fourth embodiment of the present invention, also illustrating a case where the position of a latch is adjusted to the opening portion side of a case.
Figure 26:
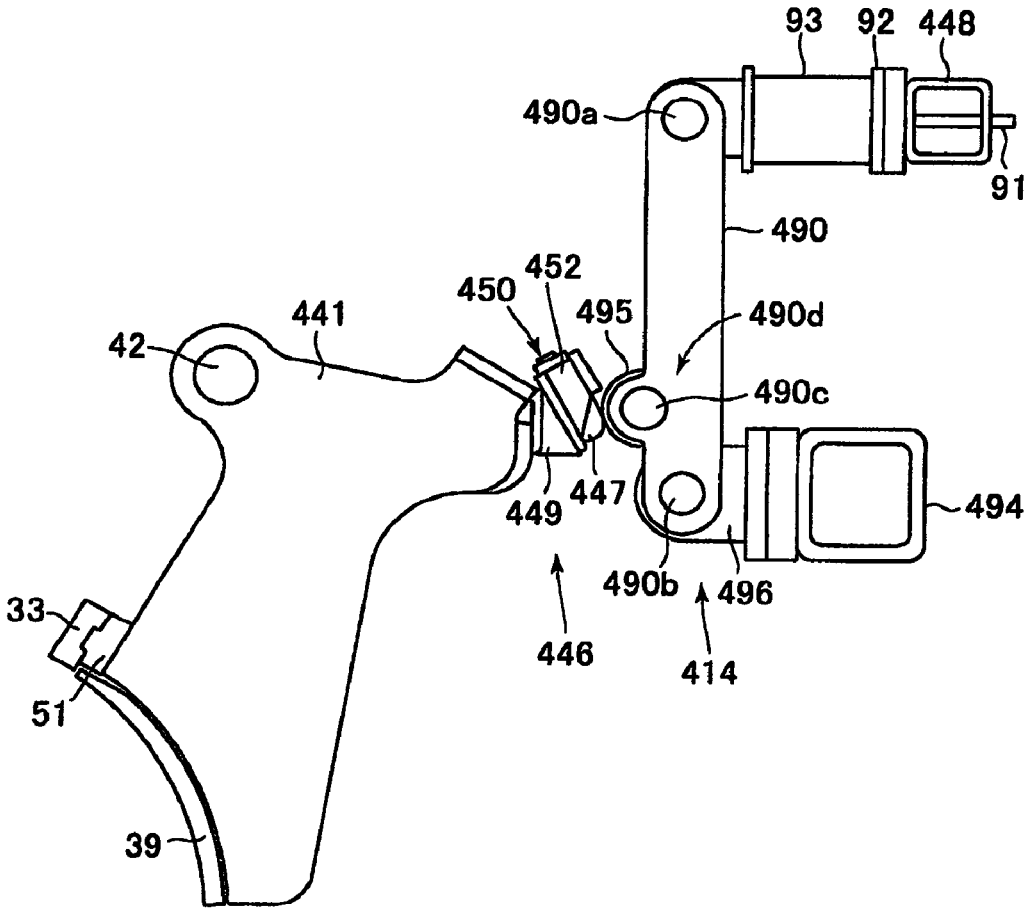
FIG. 26 is a lateral view extracting and illustrating the housing, the engaging portion thereof and the protection device as well as the peripheral configurations according to the fourth embodiment of the present invention, also illustrating a case where the position of the latch is adjusted to the back side of the case.

FIG. 25 illustrates the case where the latch 447 is disposed close to the opening portion of the case 452 with respect to the position (hereinafter, called as the reference position) of the latch 447 in FIG. 20. FIG. 26 illustrates the case where the latch 447 is disposed on the back side of the case 452.

As illustrated in FIG. 25, the distance between the head 450*a* of the bolt 450 and the latch 447 is increased to shift the latch 447 toward the opening portion side of the case 452 with respect to the reference position. This increases the projecting amount of the latch 447 toward the protection device 414, which increases the engaging amount of the engaging portion 446 with the holding portion 490*d*. Thus, the force of the holding portion 490*d* holding the latch 447 is increased. As illustrated in FIG. 26, the distance between the head 450*a* of the bolt 450 and the latch 447 is reduced to shift the latch 447 toward the back side of the case 452 with respect to the reference position. This reduces the projecting amount of the latch 447 toward the protection device 414, which reduces the engaging amount of the engaging portion 446 with the holding portion 490*d*. Thus, the force of the holding portion 490*d* holding the latch 447 is reduced.

The description is returned to FIGS. 17 to 19.

The protection device 414 includes a lever bracket 496, a lever 490, a rod 91, a roller 495, a rod support member 448, an elastic member 93 and a shim 92. The lever bracket 496 is mounted to a lever support member 494 disposed along the body-width direction (the vertical direction in the figure) and supported at both ends thereof by the side frames 19. The lever 490 is pivotably mounted at one end thereof to the lever bracket 496 via a 490*b*. The rod 91 is pivotably provided at one end of the lever 90 opposite the lever bracket 496 via a pin 490*a*. The roller 495 is turnably provided at a projecting portion 490*d*, close to the housing 441, of a barrel portion of the lever 490 via a pin 490*a*. The rod support member 448 is disposed along the body-width direction (the direction perpendicular to the sheet surface in the figure) and supported at both ends thereof by the side frames 19. The elastic member 93 is interposed between the lever 490 and the rod support member 448 to receive the rod 91 passed therethrough. The shim 92 is inserted between the rod support member 448 and the elastic member 93.

The lever support member 494 is disposed forward (on the right side in FIG. 17) of the housing 441.

The pin 490*c* of the lever 490 is disposed so that the distance between the pin 490*c* and one end close to the pin 490*b* at which the lever bracket 496 is provided is smaller than the distance between the pin 490*c* and one end close to the pin 490*a* at which the rod 91 is provided. Thus, the force applied to one end close to the pin 490*a* or a point of effort in the turning direction becomes greater at the pin 490*c* or a fulcrum because of passing the pin 490*c* or a point of load.

The lever 490 has the projecting portion 490*d* at the barrel portion close to the housing 441. The projecting portion 490*d* plays a role of a holding portion for holding an engaging portion 446 of the housing 441 to keep a posture where the anvil 33 faces the crushing chamber 31. The roller 495 is turnably provided via the pin 490*c* at an abutment position of the holding portion 490*d* against the engaging portion 446. When the engaging portion 446 moves relatively to the holding portion 490*d* of the lever 490, the roller 495 rolls on the engaging portion 446 to reduce the frictional force occurring between the holding portion 490*d* and the engaging portion 446.

The rod 91 is pivotably provided via the pin 490*a* at one end of the lever 490 on the side opposite the lever bracket 496 and is insertably fitted to the rod support member 448 secured to the side frames 19, 19. The rod support member 448 is disposed forward (in the right direction in FIG. 17) of the housing 441 and above (upside in FIG. 17) the lever support member 494. In addition, the rod 91 extends from the pin 490*a* of the lever 490 toward the rod support member 448.

During the crushing work (in the state illustrated in FIG. 17), the housing 441 is such that the engaging portion 446 is fixed and held at a closing position by the holding portion 490*d* of the lever 490 of the protection device 414 mounted to the side frames 19, i.e., in the posture where the anvil 33 is disposed in the vicinity of the rotational trajectory of the crushing bit 35. In this case, the roller 495 provided on the holding portion 490*d* of the lever 490 presses rearward the latch 447 of the engaging portion 446 of the housing 441 by the biasing force of the elastic member 93 transmitted via the lever 490. When the force of the engaging portion 446 pressing the roller 495 forward exceeds the biasing force of the elastic member 93 transmitted to the roller 495 via the lever 490, the lever 490 is turned to shift forward (in the right direction in FIG. 17) the holding portion 490*d* and the roller 495. When the displacement amount of the roller 495 of the holding portion 490*d* exceeds the engaging amount of the engaging portion 446 with the holding portion 490*d*, the engaging portion 446 of the housing 441 rides across the roller 495 of the holding portion 490*d* to permit the turning of the housing 441. With such a configuration, if an excessive impact force exceeding the reference load of the protection device 414 predetermined by adjusting the biasing of the elastic member 93 is applied to the anvil 33, the lever 490 of the protection device 414 is turned in an opening direction (counterclockwise in FIG. 17) to release the restraint of the engaging portion 446 by the holding portion 490*d*. The housing 441 is turned around the pivot shaft 42 to allow the anvil 33 to retreat from the crushing chamber 31. Thus, components of the crusher can be prevented from being damaged. In this case, even after the anvil 33 has been retreated from the crushing chamber 31 by the excessive load in this embodiment as illustrated in FIG. 19, by depressing from above the engaging portion 446 or the housing 441, the state of the anvil 33 and of the housing 441 can be returned to the state shown in FIG. 17. A stopper 50 is mounted to a stopper support member 48 secured to the side frames 19. This stopper 50 limits the turning range of the housing 441 in the opening direction (counterclockwise in FIG. 17) thereof. Thus, the housing 441 and the other constituent elements can be prevented from interfering with each other.

The other configurations of the present embodiment are the same as those of the first embodiment.

A description is given of the operation of the present embodiment configured as described above.

When the crushing work is carried out, the crushing bit 35 and the anvil 33 may hold therebetween a foreign object such as a stone, metal or the like. In such an event, an excessive load is applied from the crushing bit 35 to the anvil 33 and transmitted to the holding portion 490*d* of the lever 490 of the protection device 414 via the engaging portion 446 of the housing 441.

In the event that the impactive load in excess of the reference predetermined by adjusting the biasing force of the elastic member 93 is applied to the anvil 33, the lever 490 of the protection device 414 is turned in the opening direction (counterclockwise in FIG. 17) to shift forward the roller 495 of the holding portion. The latch 447 of the engaging portion 446 rides across the roller 495 of the holding portion to release the restraint of the engaging portion 446 by the protection device 414 to permit the turning of the housing 441. In this case, as illustrated in FIG. 19, the housing 441 and the anvil 33 are turned around the pivot shaft 42 with respect to the side frames 19 to retreat from the crushing chamber 31. Thus, components of the crusher are prevented from being damaged.

The impactive load as a reference to retreat the anvil 33 from the crushing chamber 31 is adjusted by changing the projecting amount of the latch 447 with respect to the case 452. For example, the projecting amount of the latch 447 is increased to increase the engaging amount of the latch 447 with the holding portion 490*d*, whereby the force for holding the housing 441, of the holding portion 490*d* of the protection device 414, is increased. In addition, the projecting amount of the latch 447 is reduced to reduce the engaging amount of the latch 447 with the holding portion 490*d*, whereby the force for holding the housing 441, of the holding portion 490*d* of the protection device 414, is reduced.

The hopping impactive force of the housing 441 encountered when the housing 441 is turned and retreated is absorbed by the stopper 50. In addition, the housing 441 is returned to the original position (the closing position) by its own weight. However, if a position sensor not illustrated or the like detects the retreat of the housing 441, the self-traveled crusher stops the crushing operation of the to-be-crushed object, specifically, the carrying-in of a to-be-crushed object or the like, the rotation of the crushing rotor 32, etc.

When the anvil 33 is retreated from the crushing chamber 31 by the excessive load, by depressing from above the engaging portion 446 or the housing 441 by means of e.g., a cylinder, a manual jack, a hand or the like, the state of the anvil 33 and of the housing 41 is returned to the closing position.

Also the present embodiment described above can provide the same advantage as that of the first embodiment.

The engaging portion 446 of the housing 441 is provided with the latch 447, whose position is adjusted to adjust the engaging amount with the holding portion 490*d*. With such a configuration, a load as a reference to pivotally retreat the housing 441 can be adjusted without replacing the shim 92 and elastic member 93 of the protection device 414.

Further, when the housing 441 is shifted from the opening position to the closing position, i.e., when the anvil 33 is returned from the retreat position to the crushing position, the latch 447 is pressed and slid by the holding portion 490*d* to temporarily reduce the amount of projection from the case 452. With such a configuration, the position of the anvil 33 can be restored by the smaller force.

Incidentally, in the embodiments described above take as an example, the case where the rubber spring or urethane spring is used as the elastic member of the protection device. However, the present invention is not limited to this. For example, as illustrated in FIGS. 8 and 9, the coil spring may be used as the elastic member. Additionally, the description is given by taking as an example the case where the single protection device is used. However, the invention is not limited to this. For example, the protection device may be provided at both ends of the lever support member. Further, the biasing force adjusting means for adjusting the biasing force of the elastic member against the lever is configured to adjust the biasing force by the number or thickness of the shim. However, the invention is not limited to this. For example, the biasing force adjusting means may be configured such that an adjusting screw is provided and turned to adjust the biasing force. Alternatively, the elastic member is replaced with another one having a different elastic force.

The invention claimed is:

1. A crusher comprising:

a crusher frame;

a crushing rotor rotatably supported by the crusher frame;

a housing pivotably mounted to the crusher frame;

a fixed blade supported by the housing to face a crushing chamber around the crushing rotor;

a lever disposed on a side opposite the crushing rotor with respect to the housing, installed pivotably with respect to the crusher frame, and provided with a holding portion at one part for holding the housing to keep a posture where the fixed blade faces the crushing chamber;

biasing means for biasing a different part of the lever with respect to a turning center of the lever with a set biasing force so that when a turning force applied to the lever via the holding portion exceeds the set biasing force, the lever turns to release the restraint of the housing and to permit the fixed blade to turn and retreat from the crushing chamber; and a roller turnably provided at the holding portion of the lever to be abutted against the housing.

2. The crusher according to claim 1, wherein the biasing means includes:

a rod turnably provided at the different part of the lever with respect to the lever and insertably fitted to a support member secured to the crusher frame; and spring means disposed between the lever and the support member so as to receive the rod passed therethrough.

3. The crusher according to claim 1, further comprising:

biasing force adjusting means for adjusting the biasing force of the spring means.

4. The crusher according to claim 1, wherein the biasing means is disposed on the side of the housing with respect to the lever.

5. The crusher according to claim 1, wherein the housing is provided with adjusting means for adjusting an amount of engagement with the holding portion of the lever.

6. The crusher according to claim 5, wherein the adjusting means includes a latch abutted against the holding portion of the lever, and a case secured to the housing to house the latch in such a manner that a portion of the latch is projected toward the holding portion, and wherein the adjusting means adjusts the engaging amount by adjusting a projecting amount of the latch.

7. The crusher according to claim 5, wherein the holding portion of the lever is such that an outer circumferential surface thereof abutted against the adjusting means is formed to be curved, wherein the adjusting means includes a case secured to the housing and a latch provided in the case to be movable forward and rearward and to have a curved portion that is abutted against the holding portion, and wherein a contact point between the latch and the holding portion shifts on the outer circumferential portion of the holding portion according to a forward-rearward movement amount of the latch with respect to the case to change the engaging amount between the latch and the holding portion.

8. The crusher according to claim 1, wherein the housing is formed such that a distance from a turning center relative to the crusher frame to the fixed blade is made equal to a distance from the turning center to an abutment portion against the holding portion of the lever.

9. The crusher according to claim 1, wherein the housing is formed such that a distance from a turning center relative to the crusher frame to an abutment portion against the holding portion of the lever is made shorter than a distance from the turning center to the fixed blade.

10. The crusher according to claim 1, wherein the housing is formed such that a distance from a turning center relative to the crusher frame to an abutment portion against the holding portion of the lever is made longer than a distance from the turning center to the fixed blade.

* * * * *